US010197291B2

(12) United States Patent
Rivera

(10) Patent No.: US 10,197,291 B2
(45) Date of Patent: Feb. 5, 2019

(54) FIRE BURNER

(71) Applicant: TROPITONE FURNITURE CO., INC., Irvine, CA (US)

(72) Inventor: Richard Rivera, Corona, CA (US)

(73) Assignee: TROPITONE FURNITURE CO., INC., Irvine, CA (US)

( * ) Notice: Subject to any disclaimer, the term of this patent is extended or adjusted under 35 U.S.C. 154(b) by 84 days.

(21) Appl. No.: 15/173,535

(22) Filed: Jun. 3, 2016

(65) Prior Publication Data

US 2016/0356491 A1 Dec. 8, 2016

Related U.S. Application Data

(60) Provisional application No. 62/171,152, filed on Jun. 4, 2015.

(51) Int. Cl.

| | |
|---|---|
| ***F23D 14/14*** | (2006.01) |
| ***F24C 15/08*** | (2006.01) |
| ***F23D 14/08*** | (2006.01) |
| ***F23D 14/58*** | (2006.01) |
| ***F23D 14/84*** | (2006.01) |

(52) U.S. Cl.

CPC ..... *F24C 15/08* (2013.01); *F23D 14/08* (2013.01); *F23D 14/58* (2013.01); *F23D 14/84* (2013.01); *F23D 2203/102* (2013.01)

(58) Field of Classification Search

CPC ..... F23D 14/84
USPC ..... 431/353; 126/148
See application file for complete search history.

(56) References Cited

U.S. PATENT DOCUMENTS

| | | | |
|---|---|---|---|
| 751,350 | A | 2/1904 | Schutz |
| 836,145 | A | 11/1906 | Schutz |
| 1,087,768 | A | 2/1914 | Hoffman |
| 1,367,333 | A | 2/1921 | Truesdell |
| 1,367,581 | A | 2/1921 | Bassford |
| 1,445,208 | A | 2/1923 | Forward |
| 1,471,039 | A | 10/1923 | Lee |
| 1,569,967 | A | 1/1926 | Danielsen |
| 1,613,534 | A | 1/1927 | Norman |
| 1,618,808 | A | 2/1927 | Burg |
| 1,808,120 | A | 6/1931 | Runkwitz |
| 1,808,550 | A | 6/1931 | Harpman |
| 1,814,998 | A | 7/1931 | Yocum |
| 1,917,275 | A | 7/1933 | Rossman et al. |
| 1,961,643 | A | 6/1934 | Roth |

(Continued)

FOREIGN PATENT DOCUMENTS

KR 2002-0030653 4/2002

OTHER PUBLICATIONS http://www.alibaba.com/product-tp/108119053/MODEL_TBP_1_BBQ_GRILL_PLATE.html, in 1 page, available on or before May 20, 2012.

(Continued)

*Primary Examiner* — Avinash Savani
(74) *Attorney, Agent, or Firm* — Knobbe, Martens, Olson & Bear, LLP

(57) ABSTRACT

A fire burner can have combustion ports through which fuel combusts. The combustion ports can be arranged in a curved pattern on the fire burner. As the fuel combusts on the fire burner, the fire burner can produce a pattern of combustion heat and combustion byproduct flow that causes the flame to appear to be spiraling, vortexing, and/or twirling with tornado-like characteristics.

20 Claims, 11 Drawing Sheets

(56) References Cited

U.S. PATENT DOCUMENTS 2,020,349 A 11/1935 Bennett et al.
2,145,263 A 1/1937 Huntzinger et al.
2,085,220 A 6/1937 Howlett
2,118,988 A 5/1938 Sorenson
2,136,100 A 11/1938 Crossman
2,136,708 A 11/1938 Patrick
2,143,259 A 1/1939 Clarkson
2,164,225 A 6/1939 Walker
2,198,647 A 4/1940 Wolcott
2,220,532 A 11/1940 Lombardi
2,227,608 A 1/1941 Tinnerman
2,422,918 A 6/1947 Mills
2,464,791 A 3/1949 Bonvillian et al.
2,465,712 A 3/1949 Clarkson
2,477,721 A 8/1949 Chesser et al.
2,502,664 A 4/1950 Nest
2,515,845 A 7/1950 Van Den Bussche
2,526,437 A 10/1950 Themascus, Sr.
2,546,402 A 3/1951 Ofeldt
2,561,200 A 7/1951 Hess
2,565,039 A 8/1951 Mueller
2,652,890 A 9/1953 Morck, Jr. et al.
2,787,318 A 4/1957 Wolfersperger
2,883,797 A 4/1959 Eldred
2,897,330 A 7/1959 Hopkins
2,932,528 A 4/1960 Miller et al.
3,019,721 A 2/1962 Haapala
3,079,855 A 3/1963 Valis
3,185,202 A 5/1965 Mitchell et al.
3,212,426 A 10/1965 Lewus
3,226,038 A 12/1965 Brady et al.
3,254,695 A 6/1966 Brödlin
3,301,172 A 1/1967 Haro
3,315,655 A 4/1967 Stone et al.
3,323,508 A 6/1967 Holman
3,333,526 A 8/1967 Kirkpatrick
3,347,404 A 10/1967 McIntyre
3,414,709 A 12/1968 Tricault
3,465,894 A 9/1969 Setecka
3,478,890 A 11/1969 Allsop
3,516,573 A 6/1970 Mizuk
3,536,018 A 10/1970 Phelps
3,556,701 A 1/1971 Momoda et al.
3,628,472 A 12/1971 Lausmann
3,636,299 A 1/1972 Stewart, Jr.
3,666,183 A 5/1972 Smith
3,746,499 A 7/1973 Guerre et al.
3,749,548 A 7/1973 Zink
3,759,668 A 9/1973 Yamada et al.
D229,277 S 11/1973 Chan Ming-Kong
D229,656 S 12/1973 Garcia
3,794,952 A 2/1974 Dowis
3,809,051 A 5/1974 Giroux
3,847,068 A 11/1974 Beer et al.
3,850,087 A 11/1974 Landblom et al.
3,858,529 A 1/1975 Salladay
3,987,719 A 10/1976 Kian
3,994,671 A 11/1976 Straitz, III
4,014,639 A * 3/1977 Froehlich ..... F23C 7/002 239/406
4,021,186 A 5/1977 Tenner
D246,627 S 12/1977 Sugiyama
4,128,389 A 12/1978 Straitz, III
D251,107 S 2/1979 Ottier
4,157,889 A 6/1979 Bonnel
4,157,890 A 6/1979 Reed
4,159,000 A 6/1979 Iwasaki et al.
4,175,920 A 11/1979 Guerre et al.
4,191,437 A 3/1980 Funke
4,192,465 A 3/1980 Hughes
4,198,561 A 4/1980 Fujioka
4,300,444 A 11/1981 Muse
4,391,208 A 7/1983 Lewis
4,432,334 A 2/1984 Holt
4,433,885 A 2/1984 Baker
4,436,023 A 3/1984 Takahashi
4,454,839 A 6/1984 Gater et al.
4,455,840 A 6/1984 Matt et al.
4,531,505 A 7/1985 Hait et al.
4,546,923 A 10/1985 Ii
4,561,874 A 12/1985 Colacello et al.
D282,139 S 1/1986 Radford
4,583,941 A 4/1986 Elperin et al.
D286,002 S 10/1986 Brix
4,616,626 A 10/1986 Kwan
4,635,567 A 1/1987 Haftke et al.
4,635,614 A 1/1987 Segroves
4,672,900 A 6/1987 Santalla et al.
4,687,167 A 8/1987 Skalka et al.
4,704,955 A 11/1987 Archibald
4,859,173 A 8/1989 Davis, Jr. et al.
4,909,235 A 3/1990 Boetcker
4,976,252 A 12/1990 Cianciola
5,009,151 A 4/1991 Hungerford
5,009,174 A 4/1991 Polak
5,055,031 A 10/1991 Werner
D321,810 S 11/1991 Schultz
5,165,328 A 11/1992 Erickson et al.
5,195,424 A 3/1993 Guajaca
D336,009 S 6/1993 Tringali et al.
D339,266 S 9/1993 Lockett
5,261,336 A 11/1993 Williams
5,307,621 A 5/1994 Glassman et al.
5,311,673 A 5/1994 Su
5,312,003 A 5/1994 Domenig
5,323,693 A 6/1994 Collard et al.
5,349,898 A 9/1994 Po Wo Cheung
5,349,899 A 9/1994 Tominaga et al.
5,357,871 A 10/1994 Bowman
5,359,988 A 11/1994 Hait
5,413,087 A 5/1995 Jean
D359,652 S 6/1995 Mendelson et al.
5,421,271 A 6/1995 Sui
D361,467 S 8/1995 Kabayama
5,437,108 A 8/1995 Alseth
5,465,651 A 11/1995 Erickson et al.
D364,777 S 12/1995 Schlosser et al.
D364,993 S 12/1995 Andrea
5,513,558 A 5/1996 Erickson et al.
5,525,054 A 6/1996 Nakaura et al.
D371,719 S 7/1996 Perry
5,552,577 A 9/1996 Su
5,558,008 A 9/1996 Jenkins
5,566,625 A 10/1996 Young
5,577,823 A 11/1996 Maglinger
D382,765 S 8/1997 Kellermann
D383,355 S 9/1997 Uter
5,682,811 A 11/1997 Kidushim
D387,240 S 12/1997 Simmonds et al.
5,699,722 A 12/1997 Erickson et al.
5,720,272 A 2/1998 Chiang
5,755,567 A 5/1998 Licht et al.
5,816,169 A 10/1998 MacKenzie
5,819,718 A 10/1998 Leiser
5,911,812 A 6/1999 Stanek et al.
5,921,229 A 7/1999 Blake
5,950,526 A 9/1999 Hsu
5,964,212 A 10/1999 Thompson
5,970,858 A 10/1999 Boehm et al.
5,983,496 A 11/1999 Hermanson
5,984,662 A 11/1999 Barudi et al.
6,023,051 A 2/2000 Fellows
6,036,478 A 3/2000 Inada
6,041,696 A 3/2000 Su
6,065,466 A 5/2000 Baykal
D428,305 S 7/2000 Berkes
6,082,249 A 7/2000 Su
6,092,518 A 7/2000 Dane
6,105,487 A 8/2000 Nash et al.
D431,411 S 10/2000 Chang
6,168,422 B1 1/2001 Motyka et al.
6,192,669 B1 2/2001 Keller et al.
6,201,217 B1 3/2001 Moon et al.
D440,112 S 4/2001 Su

(56) References Cited

U.S. PATENT DOCUMENTS

D442,020 S 5/2001 Pierick
D442,822 S 5/2001 Lin
6,253,976 B1 7/2001 Coleman et al.
6,254,489 B1 7/2001 Drobnis et al.
6,269,755 B1 8/2001 Boswell et al.
6,289,795 B1 9/2001 McLemore et al.
D448,604 S 10/2001 Cho
D449,490 S 10/2001 Frederick
6,314,955 B1 11/2001 Boetcker
6,354,194 B1 3/2002 Hedrington et al.
6,363,842 B1 4/2002 Lin
6,363,868 B1 4/2002 Boswell et al.
6,386,192 B1 5/2002 Weber
6,389,961 B1 5/2002 Wu
6,422,231 B1 7/2002 Hamilton et al.
6,457,601 B1 10/2002 Chappell
6,484,502 B1 11/2002 Kikuchi
6,494,710 B2 12/2002 Kim et al.
6,546,845 B1 4/2003 Lanzilli
D475,571 S 6/2003 Hopkins
D476,407 S 6/2003 Snyder
6,591,828 B1 7/2003 Schneider
6,598,598 B1 7/2003 Bratsikas
6,681,757 B1 1/2004 Rivero
6,701,912 B1 3/2004 Siegel et al.
6,708,604 B1 3/2004 Deichler, Jr.
D491,013 S 6/2004 Yang
6,769,906 B1 8/2004 Grove et al.
6,782,801 B1 8/2004 Correa et al.
6,841,759 B2 1/2005 Elwedini
6,929,001 B2 8/2005 Yoon
6,936,795 B1 8/2005 Moon et al.
D518,885 S 4/2006 Stout, Jr.
7,044,064 B2 5/2006 Li
7,086,823 B2 8/2006 Michaud
7,097,448 B2 8/2006 Chesney
7,137,258 B2 11/2006 Widener
7,219,663 B2 5/2007 Cuomo
7,225,633 B2 6/2007 DeMars
D567,166 S 4/2008 Bogani
D569,497 S 5/2008 Hoff
D579,708 S 11/2008 Chen
D592,445 S 5/2009 Sorenson et al.
7,575,002 B2 8/2009 DeMars et al.
D602,148 S 10/2009 DeFouw et al.
D604,098 S 11/2009 Hamlin
7,622,693 B2 11/2009 Foret
7,686,010 B2 3/2010 Gustavsen
7,708,006 B2 5/2010 Sun
7,721,727 B2 5/2010 Kobayashi
D621,873 S 8/2010 Tsai
D622,318 S 8/2010 Tsai et al.
D623,006 S 9/2010 Alden et al.
D623,014 S 9/2010 Alden et al.
D625,558 S 10/2010 Griffith
D627,194 S 11/2010 Marin
D627,195 S 11/2010 Marin
7,841,333 B2 11/2010 Kobayashi
D628,854 S 12/2010 Brattoli et al.
7,845,344 B2 12/2010 Sorenson et al.
D636,216 S 4/2011 Marsh
7,934,494 B1 5/2011 Schneider
D642,675 S 8/2011 Scribano et al.
8,015,821 B2 9/2011 Spytek
8,020,546 B1 9/2011 Bourgeois et al.
8,037,689 B2 10/2011 Oskin et al.
8,061,348 B1 11/2011 Rodriguez
D650,225 S 12/2011 Bartol et al.
D650,524 S 12/2011 Wilson et al.
D655,805 S 3/2012 Jonovic et al.
8,128,399 B1 3/2012 Gibson et al.
D657,442 S 4/2012 Siemieńczuk
8,166,870 B2 5/2012 Badin
8,166,893 B2 5/2012 Davis
8,181,640 B2 5/2012 Park
D661,542 S 6/2012 Lee
8,197,250 B2 6/2012 Morgan et al.
8,220,449 B2 7/2012 Rheault
D665,491 S 8/2012 Goel et al.
8,261,731 B2 9/2012 Marsh
8,267,257 B2 9/2012 Doyal
D669,730 S 10/2012 Mandil
8,291,896 B1 10/2012 Gonnella et al.
D671,364 S 11/2012 Parel et al.
8,327,837 B2 12/2012 Nam
8,330,083 B2 12/2012 Moon et al.
D678,712 S 3/2013 Mehler
8,393,317 B2 3/2013 Sorenson et al.
D679,943 S 4/2013 Zhou
8,424,450 B2 4/2013 Jeon et al.
8,430,088 B1 4/2013 Gallaher
D684,423 S 6/2013 Dobert et al.
D684,808 S 6/2013 Mehler
8,469,018 B1 6/2013 West
D686,175 S 7/2013 Gurary et al.
D686,582 S 7/2013 Krishnan et al.
D688,087 S 8/2013 Lee
8,535,052 B2 9/2013 Cadima
D690,671 S 10/2013 Gurary et al.
D693,175 S 11/2013 Saubert
D695,059 S 12/2013 Mehler et al.
D695,242 S 12/2013 Gurary et al.
D699,514 S 2/2014 Lovley, II et al.
8,641,413 B2 2/2014 Chen et al.
8,668,070 B2 3/2014 Laniado et al.
8,668,949 B2 3/2014 Wilson et al.
D706,571 S 6/2014 Rivera et al.
D707,078 S 6/2014 Rivera et al.
D710,647 S 8/2014 Mandil et al.
8,870,565 B2 10/2014 Knight
D729,915 S 5/2015 Zhang
9,091,455 B1 7/2015 Coster
D735,520 S 8/2015 Mandil
D735,525 S 8/2015 Nguyen
9,138,099 B2 9/2015 Dhuper et al.
D742,490 S 11/2015 Jepson
D743,203 S 11/2015 Filho et al.
D743,517 S 11/2015 Platt et al.
D743,531 S 11/2015 Biagioli et al.
D743,532 S 11/2015 Biagioli et al.
D743,733 S 11/2015 Lee
D743,734 S 11/2015 Lee
D749,906 S 2/2016 Lee
D752,199 S 3/2016 Berkman et al.
D752,202 S 3/2016 Berkman et al.
D758,129 S 6/2016 Filho et al.
D761,944 S 7/2016 Ediger et al.
D765,232 S 8/2016 Horsfield
D766,036 S 9/2016 Koch et al.
D769,054 S 10/2016 Lee
D774,350 S 12/2016 Mandil
D777,307 S 1/2017 Rocha
D791,930 S 7/2017 Rivera
D795,002 S 8/2017 Lee
D795,634 S 8/2017 Lee
D798,660 S 10/2017 Nadal
D799,946 S 10/2017 Sotto
D816,774 S 5/2018 Edevold
D817,697 S 5/2018 Zhao
D817,708 S 5/2018 Kim et al.
2001/0019815 A1 9/2001 Keller
2003/0075166 A1 8/2003 Glass
2004/0200359 A1 10/2004 Snider
2004/0224273 A1 11/2004 Inomata
2004/0224274 A1 11/2004 Tomiura et al.
2004/0261316 A1 12/2004 Weaver
2005/0039612 A1 2/2005 Denny
2005/0229916 A1 10/2005 Fitzgerald
2006/0154191 A1 7/2006 Gilioli et al.
2006/0191528 A1 8/2006 Spangrud
2006/0236996 A1 10/2006 Mosher et al.
2006/0266351 A1 11/2006 Griffin
2007/0151776 A1 7/2007 Hart
2007/0157857 A1 7/2007 Bottemiller

(56) References Cited

U.S. PATENT DOCUMENTS

| | | | | |
|---|---|---|---|---|
| 2007/0281256 | A1 | 12/2007 | Dodson | |
| 2008/0044537 | A1 | 2/2008 | Manuel | |
| 2008/0074864 | A1 | 3/2008 | Molders | |
| 2008/0092295 | A1 | 4/2008 | Flick et al. | |
| 2008/0188365 | A1 | 8/2008 | Dalla Piazza et al. | |
| 2008/0217266 | A1 | 9/2008 | Doyal | |
| 2008/0308645 | A1* | 12/2008 | Presley | B05B 17/08 239/17 |
| 2009/0020109 | A1 | 1/2009 | Rheault | |
| 2009/0057252 | A1 | 3/2009 | Eckenrode et al. | |
| 2009/0095168 | A1 | 4/2009 | Shu | |
| 2009/0205626 | A1 | 8/2009 | Ferreiro Cerceda | |
| 2009/0266351 | A1 | 10/2009 | Lee | |
| 2010/0276414 | A1 | 11/2010 | Nam et al. | |
| 2010/0307347 | A1 | 12/2010 | Menashes | |
| 2010/0326420 | A1 | 12/2010 | Gasparini | |
| 2012/0060819 | A1 | 3/2012 | Hunt et al. | |
| 2013/0011800 | A1 | 1/2013 | Chen | |
| 2013/0037390 | A1 | 2/2013 | Laniado et al. | |
| 2013/0081609 | A1* | 4/2013 | Dhuper | A47J 37/0781 126/25 AA |
| 2013/0252188 | A1 | 9/2013 | Chen | |
| 2014/0109587 | A1 | 4/2014 | Crothers et al. | |
| 2014/0178548 | A1 | 6/2014 | Drummond et al. | |
| 2014/0261379 | A1 | 9/2014 | Mehler et al. | |
| 2014/0290643 | A1 | 10/2014 | Potter | |
| 2014/0299584 | A1 | 10/2014 | Foret | |
| 2014/0319890 | A1 | 10/2014 | Rivera | |
| 2015/0041454 | A1 | 2/2015 | Foret | |
| 2015/0068512 | A1 | 3/2015 | Mehler et al. | |
| 2015/0075511 | A1 | 3/2015 | Kramer | |
| 2015/0144005 | A1 | 5/2015 | Becker | |
| 2015/0153041 | A1 | 6/2015 | Neumeier | |
| 2015/0226442 | A1 | 8/2015 | Alfakhrany | |
| 2016/0138828 | A1 | 5/2016 | Meritt | |
| 2016/0169542 | A1 | 6/2016 | Yoon | |
| 2016/0215726 | A1 | 7/2016 | Acocella et al. | |
| 2016/0370004 | A1 | 12/2016 | Adkins | |
| 2017/0108215 | A1 | 4/2017 | Yang | |
| 2017/0370575 | A1 | 12/2017 | Rasi | |
| 2017/0370594 | A1 | 12/2017 | Balderas et al. | |
| 2018/0073730 | A1 | 3/2018 | Acosta Herrero et al. | |

OTHER PUBLICATIONS http://www.alibaba.com/product-tp/108044193/MODEL_TPB_2_BBQ_GRILL_PLATE.html, in 3 pages, available on or before May 20, 2012.

http://www.amazon.com/Castiron-Marble-Coating-Stove-Outdoor/dp/B000216TAW/ref=sr_1_4?ie=UTF8&qid=1337562464&sr=8-4, in 3 pages, available on or before May 20, 2012.

http://www.amazon.com/Mongolian-BBQ-Grill-Cast-Iron/dp/B002A3AZQO/ref=sr_1_1?ie=UTF8&qid=1337562464&sr=8-1, in 4 pages, available on or before May 20, 2012.

http://jasonandkara.com/2007/03/10/bulgogi-korean-barbeque/, in 1 page, available on or before May 20, 2012.

http://queenarten.ec21.com/Bulgogi_Grill_Pan_with_Marble--2103258_2103271.html, in 1 page, available on or before May 20, 2012.

http://kimchimari.com/2012/02/25/pork-bbq-dweji-bulgogi/dsc_5793-640×425/, in 5 pages, available on or before May 20, 2012.

http://www.alibaba.com/product-free/111467453/Grill_Pan_Roast_Pan_Grill_Plate.html, in 2 pages, available on or before May 20, 2012.

http://www.undercovergourmet.ca/2010/10/edmontons-best-korean-bbq/, in 3 pages, available on or before May 20, 2012.

http://www.deal.com.sg/deals/singapore/BigBang-Bulgogi-Korean-BBQ-n-Steamboat-2-in-1-Buffet-3-Price-Options-Available, in 5 pages, available on or before May 20, 2012.

http://www.alibaba.com/product-free/112426845/Cast_Iron_Korean_Bowl_Set.html, in 2 pages, available on or before May 20, 2012.

http://www.alibaba.com/product-gs/296152366/BBQ_GRILL_Plate.html, in 2 pages, available on or before May 20, 2012.

http://www.eurocosm.com/Application/Products/cooking-products/architect-firepit-GB.asp, in 3 pages, available on or before May 20, 2012.

http://www.alibaba.com/product-gs/300043200/BBQ_Grill_Plate.html, in 2 pages, available on or before May 20, 2012.

Masagril Masa Series BBQ Grill Fire Pit Insert, http://www.wayfair.com/Masagril-Masa-Series-BBQ-Grill-Fire-Pit-Insert-STA227-MSG1005.html, in 3 pages, available on or before May 20, 2012.

Tropitone Fire Pit Installation and Operating Instructions, image post date Aug. 7, 2012, site visited Aug. 6, 2016, (online), <https://www.tropitone.com/sites/default/files/page_files/fire_pit_instructions_rev_e_.pdf>.

Oriflamme SUN Fire Table, image post date Oct. 14, 2013, site visited Aug. 6, 2016, (online), <http://tineye.com/search/0dbbf4a0146cf6a2ae5ceb8a7c389bedc98cbaa5/?sort=crawl_date&order=asc>.

Oriflamme Swirl Burner, image post date Apr. 16, 2008, site visited Aug. 6, 2016, (online), <http://tineye.com/search/669d5f5726c577d82506b0fbb0e400c9ac02b3d0/>.

Logarithmic spirals—patterns created using beams of light, image post date May 12, 2015, site visited Aug. 6, 2016, (online), <http://physicsworld.com/cws/article/news/2015/may/12/swirling-light-beams-carve-intricate-patterns>.

NPL date for detail of a gas stove burner from Tin Eye, image post date May 21, 2016, site visited Nov. 9, 2016, (online ), <https://www.tineye.com/search/cfc77 a27 cde 7e2b03fe89f662bdf5cd782ce569c/?plug inver=>.

http://www.deal.com.sg/deals/singapore/BigBang-Bulgogi-Korean-Bbq-n-Steamboat-2-in-1-Buffet-3-Price-Options-Available, in 9 pages, available on or before May 20, 2012 (per Internet Archive Wayback Machine, http://web.archive.org/web/20120627072226/http://www.deal.com.sg/deals/singapore/BigBan g-Bulgogi-Korean-BBQ-n-Steamboat-2-in-1-Buffet-3-Price-Options-Available), Accessed on Oct. 14, 2016.

Detail of a gas stove burner, image post date May 21, 2016, site visited Nov. 9, 2016, (online), http://www.gettyimages.com/detail/photo/close-up-of-a-gas-stove-burner-high-res-stock-photography/126154789 with TinEye, (online), https://www.tineye.com/search/cfc77a27cde7e2b03fe89f662bdf5cd782ce569c/?pluginver=, indicating a publication date of Jan. 29, 2011.

Glaro Canopy Top, image post date Jan. 17, 2006, site visited Nov. 9, 2016, (online), http://web.archive.org/web/20060117024552/http://www.hippopro.com/Waste_CanopyTop.htm.

Rain Canopy Trash Can Lid, image post date Sep. 6, 2010, site visited Nov. 9, 2016, (online), https://www.tineye.com/search/085ff68eeafe4e75c351fda9c670c7f7f3b81895/.

Firenado 36-Inch Natural Gas Spiral Ring Burner, image post date 2018, site visited Jul. 23, 2018, (online), <http://blazingembers.com/firenado-36-inch-natural-gas-spiral-ring-burner-stainless-steel/>.

Pic-187705448-stock-photo-natural-gas from Tin Eye, image post date Apr 21, 2014, site visited Jul. 23, 2018, (online), <https://www.ti neye .com/search/9a8c609ca646a8e0fa372d2623b 1602c861 e0 176/?extension_ ver=>.

* cited by examiner

FIRE BURNER

CROSS-REFERENCE TO RELATED APPLICATION

This application claims the benefit under 35 U.S.C. § 119(e) of U.S. Provisional Application No. 62/171,152, filed Jun. 4, 2015, which is hereby incorporated by reference in its entirety and made a part of this specification.

BACKGROUND

Field

The present disclosure generally relates to fire burners and more particularly to fire burners that can be used with fire pits, fire pit openings in tables, or other heat producing devices such as stoves.

Description of the Related Art

A number of fire pit or heat producing devices are available. Fire pit devices can provide ambient light as well as limited heat for the enjoyment of an observer. Fire pit devices can provide the light and heat source using coals, firewood, natural gas, or electricity.

The fire pit devices can also be used as cooking devices, such as barbeque grills, for cooking food are available. Cooking devices provide a heat source to cook the food. The cooking devices can provide the heat source using coals, firewood, natural gas, or electricity (e.g., heat plate, heat coils). Some cooking devices provide a grill over the heat source to cook the food.

This Background is provided to introduce a brief context for the Summary and Detailed Description that follow. This Background is not intended to be viewed as limiting the claimed subject matter to implementations that solve any or all of the disadvantages or problems presented herein.

SUMMARY

A need exists for a versatile fire pit for user enjoyment and/or cooking. A fire pit can provide ambient light and/or heat. The fire pit can have a fire burner that combusts fuel. The fire pit can have a cooking grill that can be provided over the fire burner to cook foods and removed when food cooking is not desired. While cooking food on the cooking grill, the fire pit can continue to provide ambient light and/or heat. The fire pit can provide an interactive and social cooking media on a fire pit that is relaxing and entertaining for the parties involved.

A fire burner can have a central portion connected to a perimeter or periphery. The fire burner can have combustion ports positioned or arranged along curvilinear lines between the central portion and the periphery. A series or plurality of combustion ports (e.g., three or more) can be positioned along each curvilinear line. The curvilinear lines can form a spiral or curved pattern on the fire burner. A wall can connect the central portion and the periphery. The combustion ports can be positioned on the wall. The wall can slope downwards from the central portion to the periphery. The fire burner can have an inner volume for containing and dispersing a combustion gas substantially throughout or most of the inner volume and/or to substantially or most/majority of the combustion ports. The inner volume can taper or become smaller toward the periphery of the fire burner (e.g., relative to a center area of the inner volume) to facilitate dispersion of the combustion gas substantially throughout or most of the inner volume and/or to substantially or most/majority of combustion ports. The central plate can have a substantially planar (e.g., flat) surface to facilitate dispersion of the combustion gas substantially throughout or most of the inner volume and/or to substantially or most/majority of combustion ports.

The fire burner can be designed to impart or cause a spiral, helical, cyclonic, twister, or vortex pattern in the flame (e.g., tornado-like). The fire burner can have combustion ports through which fuel combusts. The combustion ports can be arranged in a curved pattern (e.g., spiral pattern) on the fire burner. The curved pattern of the combustion ports can extend from a center of the fire burner at a radius that is different than a radius of a circular fire burner such that the combustion ports are arranged in a curved pattern on the fire burner. As the fuel burns/combusts on the fire burner, the fire burner can produce a pattern of combustion heat and combustion byproduct flow that causes the flame to appear to be spiraling, vortexing, and/or twirling with tornado-like characteristics (e.g., the flame whips, whirl, spins, and/or turns around or about a central axis of the fire burner).

The fire burner disclosed herein can have a solid monolithic central portion (e.g., not perforated with combustion ports) substantially at a central axis of the fire burner. The central portion can facilitate distribution of fuel throughout an inner volume of the fire burner to help ensure sufficient combustion of fuel throughout a desired extent or area of the fire burner (e.g., from the central portion substantially to a periphery of the fire burner).

The fire burner can have combustion ports arranged in a curved pattern extending from the central portion to the periphery of the fire burner. The curved pattern can include a plurality of curved lines or paths extending or radiating out from the center (e.g., central portion) of the fire burner toward the periphery of the fire burner in a spiral-like arrangement. A series of combustion ports can be positioned along each of the curved lines of the curved pattern.

The combustion ports of the fire burner can be arranged such that there is a temperature gradient of the flame from the central portion to the periphery of the fire burner over the combustion ports (e.g., across an area of the combustion ports over which fuel combusts to form a flame). For example, the flame can be progressively hotter or have a higher temperature over the combustion ports from the periphery to the central portion of the fire burner (including a center or central axis of the fire burner). Accordingly, the relatively hotter flame toward the central portion of the fire burner may rise faster than the relatively colder flame toward the periphery of the fire burner. The faster rising hotter flame toward the central portion can create an updraft that draws in the relatively colder flame and/or surrounding (colder) air from the periphery to fill in a vacuum (reduced pressure) caused by the faster rising flame and/or air proximate to the central portion.

At least some of the combustion ports can be positioned on the fire burner in a curved or spiral pattern. When the peripheral colder flame and/or surrounding air is drawn toward the updraft of the central hotter rising flame, the peripheral colder flame and/or surrounding air can travel or proceed substantially along the curved pattern of the combustion ports or along travel paths substantially corresponding to the curved pattern of the combustion ports. The curved pattern of combustion ports can be arranged such that the peripheral colder flame and/or surrounding air meets or encounters the updraft of the hotter rising flame from the side (e.g. a trajectory not directed toward the central axis of the fire burner). The peripheral colder flame and/or surrounding air can encounter the updraft from an angle that causes the central hotter flame to spin about the central axis of the fire burner (as well as entrain the colder flame and/or surrounding air into the updraft to also spin about the central axis).

At least some of the combustion ports can be positioned on a sloped surface of the fire burner such that combustion ports proximate to the central portion of the fire burner are at a greater height (e.g., higher) along the central axis of the fire burner relative to combustion ports proximate to the periphery of the fire burner. As the peripheral colder flame and/or surrounding air is drawn toward the updraft created by the central faster rising hotter flame, the peripheral colder flame and/or surrounding air is drawn inwards toward the center of the fire burner as well as upwards toward the higher positioned hotter flame proximate to the central portion, imparting further velocity and momentum to the peripheral colder flame and/or surrounding air.

The fire burner can have an inner volume containing combustion fuel (e.g. gas and air mixture) before the fuel is combusted. The inner volume can be shaped to help facilitate sufficient combustion of fuel toward the periphery of the fire burner. For example, the inner volume can taper or become smaller toward the periphery of the fire burner such that at least some of the fuel leaves the fire burner at combustion ports most proximate to the periphery of the fire burner.

The size and/or diameter of the combustion ports can be varied to help facilitate the peripheral colder flame traveling substantially along the paths of the curved pattern of the combustion ports or paths substantially corresponding to the curved pattern of combustion ports. Further, the size and/or diameter of the combustion ports can be varied to help ensure that the flame is hotter or at a higher temperature over the combustion ports proximate to the central portion of the fire burner relative to the flame over the combustion ports proximate to the periphery of the fire burner. In addition, the size and/or diameter of the combustion ports can be varied to help ensure sufficient combustion over the combustion ports most proximate to the periphery of the fire burner.

Stated differently, the fire burner can combust the fuel such that a relatively higher combustion temperature is concentrated toward or proximate to the center of the fire burner relative to the combustion temperature at the periphery of the fire burner. The relatively hotter combustion byproducts at the center will tend to rise faster than the relatively colder combustion byproducts at the periphery. As the relatively hotter combustion byproducts at the center rise faster, the relatively colder combustion byproducts at the periphery get drawn in toward the center to create a flow of combustion byproducts and air toward the center of the fire burner due to a relative vacuum created by the faster rising central combustion byproducts. The rise of the relatively hotter central combustion byproducts can cause a convection action that draws the combustion byproducts (e.g., flame) from the perimeter toward the center of the fire burner, drawing in more (cooler) air as a vacuum is created about the periphery or perimeter of the fire burner to replace the hotter combustion byproducts and/or air that are rising. The hotter the central combustion byproducts are, the greater the convection action to draw in the combustion products and/or air toward the center (e.g. like a chimney). Accordingly, the fire burner can create a flame or combustion/burn pattern where flame/combustion byproducts are progressively hotter (e.g. higher temperature) from the periphery toward the center of the fire burner.

The fire burner can have combustion ports arranged in a curved pattern such that the relatively colder combustion byproducts at the periphery of the fire burner are drawn or pulled in toward the center of the fire burner at an angle or trajectory that does not intersect (e.g., not headed toward or directly toward) the central axis of the fire burner. For example, the relatively hotter central combustion byproducts can form a suction vortex (e.g., an updraft) of rising combustion product byproducts. The relatively colder peripheral combustion byproducts are drawn in toward the suction vortex to intersect or mix with the suction vortex of the relatively hotter central combustion byproducts from the side of the suction vortex (e.g. forming a cord through a periphery of the suction vortex of hotter combustion byproducts or tangential to the suction vortex of hotter combustion byproducts). Accordingly, the fire burner disclosed herein can create a swirl pattern in the flame substantially without other structural and/or powered assistance (e.g., without directed air vents, directed air fans, glass tubes enclosing, for example, the flame, etc.). In some embodiments, structural and/or powered assistance may be provided to further help create a swirl pattern in the flame as discussed herein. The swirl pattern of the flame as discussed herein gets or becomes closer together (e.g., compacted) at the center relative to the perimeter or periphery of the fire burner as the flame rises and as the flame rotates about the center of the fire burner.

By being drawn in at an angle that is not directed toward the center axis of the fire burner, the peripheral combustion byproducts have momentum that is tangential to the suction vortex of the hotter combustion byproducts (e.g., tangential along a radius from the central axis of the fire burner). The peripheral combustion byproducts have momentum leading away from the central axis of the fire burner. When the peripheral combustion byproducts mix or encounter the relatively hotter central combustion byproducts, the mixture of peripheral and central combustion byproducts are caused to spin about the central axis as the mixture of combustion byproducts rises along the central axis while at least the peripheral combustion byproducts are drawn/pulled in toward the center. The spinning of the combustion byproducts creates a vortex or curved pattern in the flame as the flame rises that is visible to a viewer.

To create a relatively higher temperature of combustion byproducts toward the center of the fire burner, the combustion ports can be more frequent and concentrated (e.g., more densely positioned) toward the center of the fire burner. With more combustion ports positioned toward the center of the fire burner, the temperature toward the center of the fire burner will tend to be hotter relative to the periphery of the fire burner that has a lesser frequency of combustion ports (e.g., less densely positioned) for a given area of the fire burner.

The diameters of the combustion ports can be varied to further help impart, cause, and/or produce the variance in temperature of the combustion byproducts as discussed herein. For example, combustion ports with larger diameter openings can be provided near or proximate to the center of the fire burner such that more combustion gas escapes and burns near the center of the fire burner to produce higher temperatures. Alternatively or in combination, more (e.g., larger number of) combustion ports can be provided proximate to the center of the fire burner, but have relatively smaller diameter openings.

The fire burner can have a wall or surface that is sloped downwardly from the center toward the periphery of the fire burner to further facilitate creating momentum (e.g., upward movement) in the peripheral combustion byproducts. For example, the combustion ports proximate or near the periphery can be at a lower height relative to the combustion ports proximate or near the center of the fire burner. Since the hotter central combustion byproducts will be rising at a faster rate relative to the peripheral combustion byproducts as discussed herein, the peripheral combustion byproducts will not only be drawn toward the center of the fire burner, but also the peripheral combustion byproducts will rise from a lower height on the fire burner toward the higher central combustion byproducts. Accordingly, the peripheral combustion byproducts will have more momentum to impart a spiral to the flame when the peripheral combustion byproducts encounter or mix with the central combustion byproducts.

A balance can be achieved where a sufficient amount of combustion gas (e.g., fuel) is exits and is burned near the center of the fire burner to create the relatively hotter central combustion byproducts while simultaneously providing sufficient combustion gas flow to travel toward the peripheries of the fire burner to combust proximate to the periphery of the fire burner. To achieve this balance, the fire burner can have a central portion or cap that is substantially flat and positioned substantially over a fuel port of the fire burner. The central portion of the fire burner can have minimal or no combustion ports such that combustion gas rising through the fuel port into an inner volume of the fire burner before combustion comes against the central portion and remains in the inner volume (e.g., substantially does not leave the inner volume of the fire burner at the central portion to be combusted at the central portion). Because the central portion has no or relatively fewer combustion ports (relative the rest of the fire burner), a majority or all of the gas is directed away from the central portion of the fire burner (e.g. directed radially outward or away from the central axis). Accordingly, flow of the combustion gas is directed toward the peripheries of the fire burner before substantially any of the combustion gas leaves the inner volume of the fire burner.

Further distribution of the combustion gas can be facilitated by the inner volume tapering or becoming smaller toward the periphery of the fire burner. For example, as the combustion gas escapes and burns at the combustion ports proximate to the center of the fire burner, there is less combustion gas traveling toward the periphery of the fire burner. In order to maintain a sufficient pressure on the combustion gas to continue to travel toward the periphery of the fire burner, the inner volume can taper to maintain a desired level of gas pressure at or proximate to the periphery of the fire burner such that at least some of the gas leaves and combusts proximate to the periphery of the fire burner.

A fire pit can incorporate a fire burner as discussed herein. A fire pit with a fire burner can provide a central ambient light and/or cooking area that is integral to a tabletop surface. A user or viewer, which can include a group of users or a party of users, can use the tabletop as a table for setting items down, including food items, plates, utensil, etc. The user can also use it as a table for eating. Users can be around or sit around the tabletop to enjoy luminescence and/or heat of a fire pit. Users can also sit around the tabletop to cook foods on a cooking grill over the fire pit while still enjoying the luminescence and/or heat of a fire pit. A fire pit can serve as a patio or dining table. The cooking grill can be used with the fire pit or dining table. After cooking the food, the user can leave or remove the cooking grill from the fire pit or dining table while enjoying the cooked food at the same table as the fire pit provides fire luminescence. The user can manipulate controls on the fire pit that increase or decrease the ambient light and/or heat produced by the fire pit.

The fire pit and/or fire burner can direct air, flame, heat, and/or combustion byproducts to help prevent or inhibit soot formation. The arrangement can direct air, flame, heat, and/or combustion byproducts to help create a vacuum that draws in air from the sides of the fire burner for combustion by the fire burner. The arrangement can direct air, flame, heat, and/or combustion byproducts to help prevent melting of the fire pit and/or fire burner. The arrangement can direct air, flame, heat, and/or combustion byproducts to help direct air, flame, heat, and/or combustion byproducts toward the center. The arrangement can make the middle portion of the fire burner be the hottest portion of the fire burner during combustion of fuel.

The fire burner can create a partial vacuum at the sides of the fire burner to draw air in for improved combustion of the fuel by the fire burner. Proper combustion can include a desired flame color, height, and/or no or substantially no smoke. Proper combustion can help prevent soot formation. Proper combustion can also help regulate color, size, and/or intensity (heat) of the flame. The vacuum and/or proper combustion can at least in part be a result of the slope and/or the arcuate shape of the middle portion of the fire burner directing the air, flame, heat, and/or combustion byproducts toward the center of the fire burner. As the air, heat, and/or combustion products are directed toward the center portion, the flame can be channeled toward a center of the fire pit to have a peak (highest) flame at the center due to an updraft or chimney effect.

The fire pit and/or fire burner can have a heat output ranging from about 8,000 to about 100,000 BTUs. The fire burner can have various shapes such as round, circular, oval, square, rectangular, triangular, oval, or other polygonal and/or round shapes. The fire burner can have 5 to 300 combustion ports. In some embodiments, a smaller number of combustion ports in the burner piece directly correlates to relatively larger size (e.g., diameter) of the combustion ports. A greater number of combustion ports, such as 180 openings, in the burner allows for more air to be drawn in at the air intake of the fire pit, creating a more efficient burn. However, a more efficient burn can create less fire light ambiance (visible flame) that is desired from a fire pit flame. A large air intake for the fire pit can be provided to allow for a reduction of the number of combustion ports, such as 150 combustion ports in the burner, to have a more efficient burn of the flame while still providing fire light ambiance. The larger air intake can also create more intuitive control of the fire pit, such as the user turning up the gas (e.g., combustion fuel) to the fire pit to provide a larger and/or hotter flame substantially without soot buildup. The larger air intake of the fire pit can help prevent soot buildup while providing a larger (e.g., taller) and hotter flame.

The fire pit and/or fire burner can be designed to burn fuel at a high efficiency to minimize fuel consumption, as well as minimize the formation of undesirable combustion byproducts (soot or smoke) that have not been fully consumed during the combustion process, which can be toxic to inhale. An inefficient flame can result in the formation of undesirable combustion byproducts and black smoke. Undesirable combustion byproducts can settle on a cooking grill as soot when the fire burner is used for cooking. An indication of efficient combustion can be the absence of smoke during combustion, and/or a blue flame, indicating high temperatures, typically in excess of 1,000 degrees Fahrenheit. The fire pit designs disclosed herein can achieve a relatively high yellow luminescent flame while combusting fuel at a high temperature efficiently and cleanly. A high flame height can be about 1 to about 5 feet tall, including about 2 to 3 feet tall.

The fire pit table as discussed herein can be adapted to be used with various accessories. For example, the fire pit can be used with a cooking grill or an oven placed over the fire pit. The oven can be, for example, a pizza oven. The oven can be used to also cook other food items normally cooked in a baking oven. The oven can provide conventional baking oven capabilities while enjoying the fire pit in an outdoor environment. The table can also be used with a turntable or a Lazy Susan. When the fire pit is not used or used in a low setting, the Lazy Susan may hold food items that can be rotated about a central axis for ease of access by each user around the table. Alternatively, the table can be used with a bucket. The bucket can be, for example an ice bucket for maintaining coolness of beverages. The bucket can be used for other food types as desired by the user.

The foregoing is a summary and contains simplifications, generalization, and omissions of detail. Those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of any subject matter described herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1:
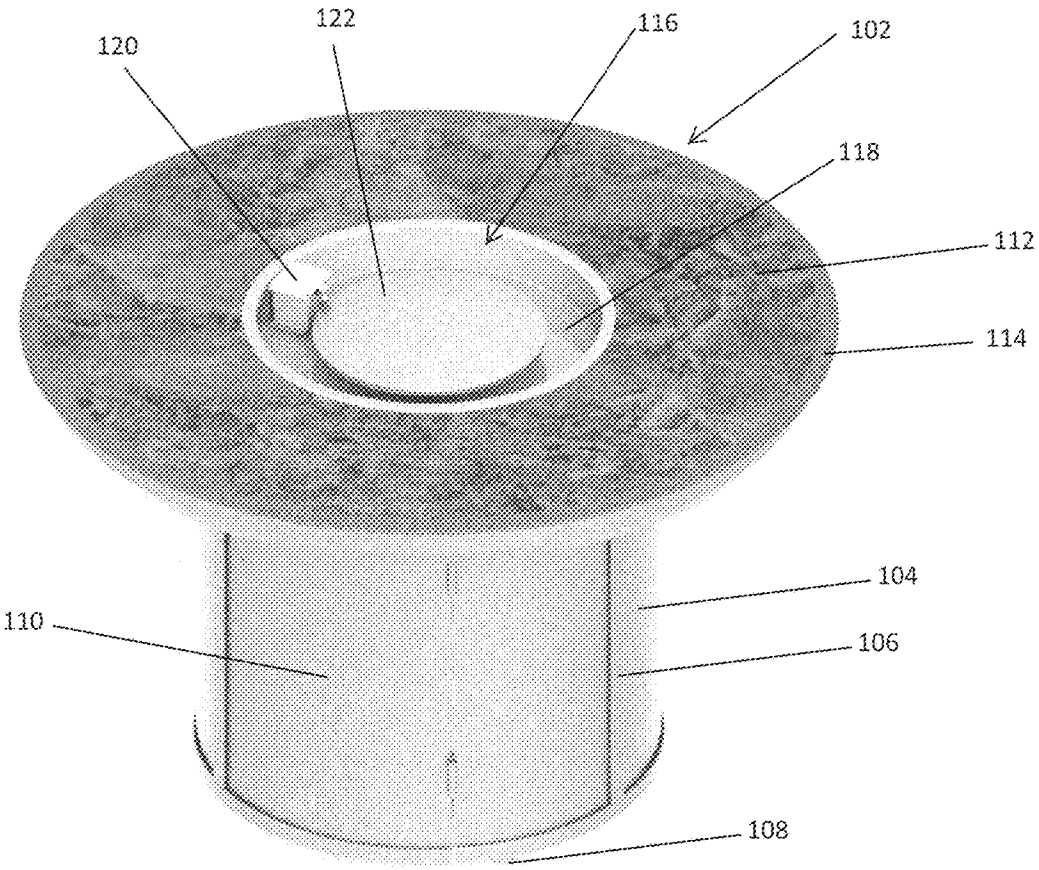
FIG. 1 illustrates a top perspective view of an embodiment of a fire pit.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made a part of this disclosure.

FIG. 1 illustrates a top perspective view of an embodiment of a fire pit 102 (e.g., a table with a fire pit). The fire pit 102 can have walls 104 between posts 106. The posts 106 can connect to supports 108 that can rest on the floor or ground below to provide support for the fire pit 102. The fire pit 102 can have doors 110. The doors 110 can swing open to reveal a space or compartment for storing the mechanisms for the fire pit 102 to function (e.g., controls, piping, and/or combustion fuel or tanks). The fire pit 102 can be a propane and/or natural gas fire pit. A propane tank can be housed within the walls 104 and doors 110. In some embodiments, fire pit 102 can connect to and house a 1 lbs. propane tank for portability (i.e., for use during camping). In some embodiments, the fire pit 102 can connect to and house a 20 lbs. or any other size propane tank for longer fuel combustion time.

The fire pit 102 can have a tabletop 112. The tabletop 112 can be bound by a border 114. The tabletop 112 and border 114 can be circular. In some embodiments, the tabletop 112 and border 114 can be square. In some embodiments, the tabletop 112 and border 114 can be any suitable shape, such as, for example, rectangular, triangular, oval, or other polygonal and/or round shapes.

The tabletop 112 can have an opening 116 housing a burner tray 118. The opening 116 can be generally round or circular. In some embodiments, the opening 116 can be square. In some embodiments, the opening 116 can be other suitable shapes, such as, for example, square, rectangular, triangular, oval, or other polygonal and/or round shapes. The opening 116 can be about 12 to about 18 inches in at least one dimension, including a diameter or a side. The burner tray 118 can have corresponding shapes and the dimensions as discussed herein for the burner tray 118 to rest within and be supported within the opening 116 (e.g., via a lip or flange of the burner tray 118 that rest on the tabletop 112 about a periphery of the opening 116). In some embodiments, the opening 116 can be filled with burning media. Burning or hot reusable media can include stones, glass, or other materials suitable that can withstand heat generated by the fire pit. The media can help with radiance of heat as well help provide ambience (luminescence). The media can include stones, glass, or other materials suitable to withstand heat generated by the burners of the fire pit.

As illustrated in FIG. 1, the burner tray 118 can house a pilot fire box 120. The pilot fire box 120 can be connected to the internal mechanisms of the fire pit 102 such as, for example, a propane tank and an air intake. The pilot fire box 120 can be connected to a burner or fire burner 122 (e.g., a combustor). The fire burner 122 can be connected to the internal mechanisms of the fire pit 102 such as, for example, the propane tank and the air intake as discussed herein. The fire burner 122 can be manufactured such that the fire burner 122 is an aesthetically finished product (e.g., the opening 116 of the fire pit 102 is not filled or partially filled with burning media such that fire burner 122 is visible to a user/viewer). The fire burner 122 can form a luminescent fire as discussed herein. The fire burner 122 can be used for other applications as well, such as cooking foods. In some embodiments, the fire burner 122 can be used in other combustion or heat producing apparatuses/devices such as stoves, ovens, cookers, heaters, kilns, etc.

In some embodiments, the fire pit 102 can have a heat output ranging from about 8,000 to about 100,000 BTUs, including about 20,000 to about 90,000 BTUs, including about 30,000 to about 80,000 BTUs, including the foregoing values and ranges bordering therein. The foregoing heat output can make the fire pit 102 (e.g., areas around the opening 116 and/or fire burner 122) reach temperatures of up to about 800° Fahrenheit, up to about 700° Fahrenheit, including about 400 to 660° Fahrenheit, including the foregoing values and ranges bordering therein. Thus, the fire pit 102 versatility allows it be used over a broad range of applications, including light ambiance and/or cooking applications. The fire pit 102 may designed to provide fire or light for ambiance and/or cooking with higher than typical BTU output (e.g., relative to conventional stovetops or fire pits).

The fire pit 102 can have a controller, such as, for example, a turning knob. The controller can control the rate of fuel combustion by the fire burner 122. The controller can control fuel intake. The controller can control air intake. The controller can be used to achieve a desired level of fire light ambiance from the flame and/or desired cooking temperature. The controller can control a gas valve for regulating flame height.

In some embodiments, the fire pit 102 uses liquefied petroleum fuel. Liquefied petroleum can have many elements used during the manufacture of the fuel that can result in fuel combustion with byproducts and soot buildup. The fire pit 102 can use air induction as discussed herein in the fuel stream to mitigate byproducts and soot buildup during combustion. Air induction can include forced air and/or drawn air through venturi induction.

Figure 2:
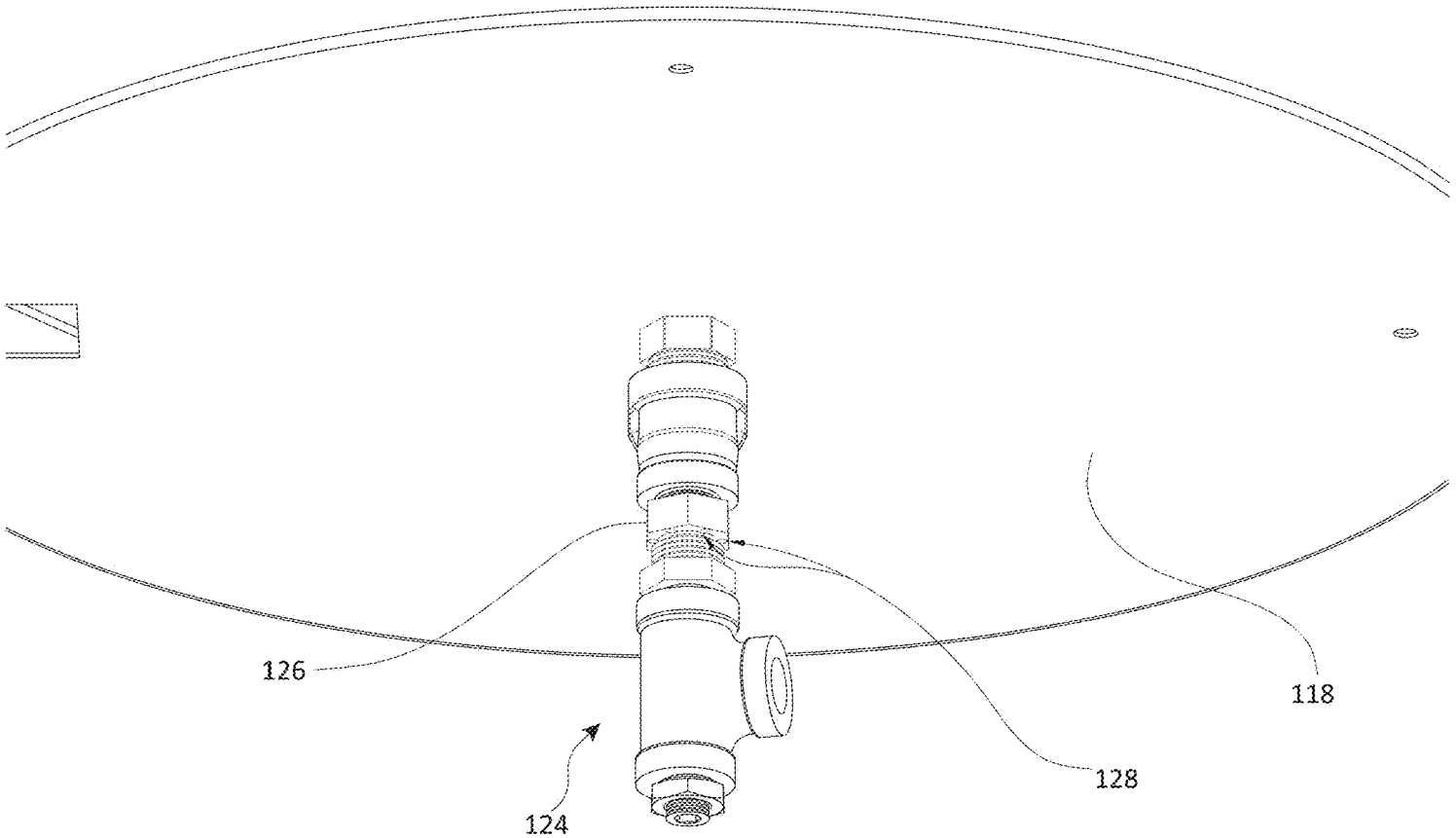
FIG. 2 illustrates a bottom partial isometric view of a burner tray.

FIG. 2 illustrates a bottom partial isometric view of a burner tray 118 with a fuel connect or gas port 124. The fuel connect 124 can have a fuel orifice 126 with venturi openings (or air induction ports) 128. The venturi openings 128 can be located close to the point of combustion (i.e., relatively close to the fire burner 122) to aid in efficient fuel combustion and reduce undesirable pressure variances. Air and fuel can be induced by creating negative pressure at the fuel orifice 126. The BTU rating of the fire pit 102 can be based at least partly on the specific arrangement and vicinity of the fuel connecter 124, including fuel orifice 126 and/or venturi openings 128. The fuel connect 124 can operably connect to a controller of the fire pit 102 to regulate combustion rate, flame height, and/or flame luminescence as discussed herein.

Figure 3:
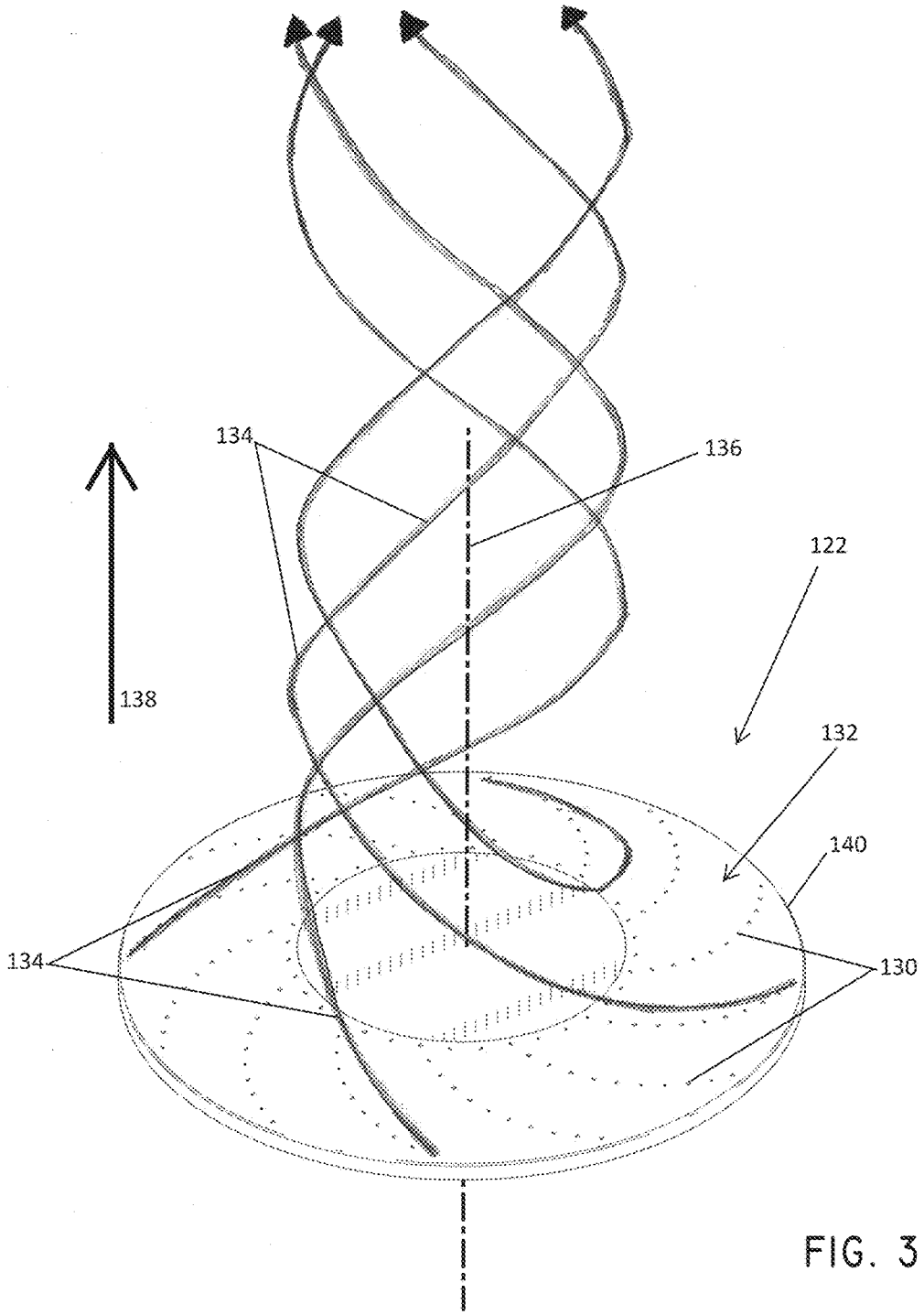
FIG. 3 illustrates a top isometric view of an embodiment of a fire burner.

FIG. 3 illustrates a top isometric view of an embodiment of a burner or fire burner 122. The fire burner 122 can have one or more or a plurality of combustion ports, openings, holes, or orifices, 130. The combustion ports 130 can be positioned in a predetermined or desired pattern such as a spiral or a series of curves (e.g., curved lines or paths) on a top, a top portion, or top component 132 of the fire burner 122. The predetermined pattern of combustion ports 130 can also be considered to be a series of coils, curls, and/or helixes as discussed herein.

As discussed herein, combustion of fuel (e.g., fuel such as liquefied petroleum or a mixture of fuel and air to be combusted) occurs over, on, or at the combustion ports 130 or other combustion ports as discussed herein. Stated differently, fuel combusts over, on, or at the combustion ports 130. Accordingly, fuel combusts in predetermined patterns over, on, or at the combustion ports 130 as discussed herein (rather than entraining, inducing, or directing just air in a predetermined manner) to form a flame with a desired pattern in the flame (e.g., combustion byproducts).

The curved pattern of combustion ports 130 can impart or cause combustion byproducts (e.g., fire/flame) to rise in a curved pattern as indicated by spiral arrows 134. As the combustion fuel and/or combustion gas (e.g., fuel and air) is combusted on the fire burner 122, the combustion byproducts are formed along the predetermined pattern of the combustion ports 130 and are drawn (e.g., pulled or directed) toward a central or center axis 136 (e.g., radial center axis) of the fire burner 122 as discussed herein. Via natural convection or rise of heat generated by combustion, the combustion byproducts can rise, proceed, or travel along directional arrow 138 (e.g., upward along the central axis 136 relative to the orientation shown in FIG. 3). While four spiral arrows 134 are shown in FIG. 3 for illustrative purposes corresponding to certain combustion ports 130 positioned in a curved pattern, it is understood that similar spiral arrows of convection pattern apply to the other combustion ports 130 that are placed in a curved pattern to impart a curved pattern to the combustion byproducts as discussed herein.

As discussed herein, the combustion ports 130 can be sized and/or positioned such that combustion heat is concentrated (e.g., higher) proximate to the center or central axis 136 of the fire burner 122. Higher combustion heat proximate to the center of the fire burner 122 will cause the combustion byproducts to rise faster near the center of the fire burner 122 relative to a periphery or perimeter 140 of the fire burner 122. As the fuel combusts along the combustion ports 130 near or proximate to the periphery 140, the combustion byproducts proximate to the periphery 140 of the of the fire burner 122 will be pulled in or drawn toward the center of the fire burner 122 (e.g., toward central axis 136) as the relatively hotter combustion byproducts near or proximate to the center of the fire burner 122 rise faster relative to the combustion byproducts proximate to the periphery. Stated differently, because hotter combustion byproducts rise faster than colder combustion byproducts (and/or surrounding or ambient air), the relatively hotter combustion byproducts proximate to the center of the fire burner 122 will rise faster than or relative to the combustion byproducts proximate to the periphery 140. The faster rise of the central combustion byproducts can create a relative vacuum or less pressure toward the center such that the peripheral combustion byproducts and surrounding (peripheral) air rush (e.g., are drawn or pulled in) toward the center of the fire burner 122 (e.g., toward the central axis 136). Since the peripheral combustion products burn or combust along combustion ports 130 placed in a curved pattern, the peripheral combustion byproducts proceed or travel substantially along the curved pattern or along travel paths substantially corresponding to the curved pattern toward the central axis 136 with the projected travel path along the curved pattern being away from or not intersecting the central axis 136.

Accordingly, the peripheral combustion byproducts and/or peripheral air drawn toward the center of the fire burner 122 encounter and/or mix with the central combustion byproducts along the curved pattern such that as the peripheral and central combustion byproducts mix, the mixed rising combustion byproducts rise turn or rotate about the central axis 136 in a pattern substantially corresponding to the curved pattern of the combustion ports 130. Stated differently, the curved pattern of the combustion ports 130 imparts or causes a travel trajectory of the peripheral combustion byproducts toward the central combustion byproducts from the side of the updraft of the central combustion byproducts (e.g., relative to a suction vortex of central combustion byproducts that may be spinning as discussed herein).

As the peripheral combustion byproducts encounter and mix with the rising central byproducts from the side (e.g., encountering the updraft of the central combustion byproducts at an angle that not directed toward the central axis 136), the trajectory of the peripheral combustion byproducts causes the central combustion byproducts (as well as resulting mix of peripheral and central combustion byproducts) to spiral or turn substantially about the central axis 136 as illustrated by spiral arrows 134. In different terms, the peripheral combustion byproducts approach the updraft of central combustion byproducts from the side such that the trajectory of the peripheral combustion byproducts form a geometrical chord through the updraft or suction vortex (e.g., through a boundary of the updraft or suction vortex) of the rising central combustion byproducts to impart or cause a spiral, vortex, or tornado-like spinning pattern to the resulting mix of rising combustion byproducts (e.g., peripheral and central combustion byproducts as well as drawn in air).

Figure 4:
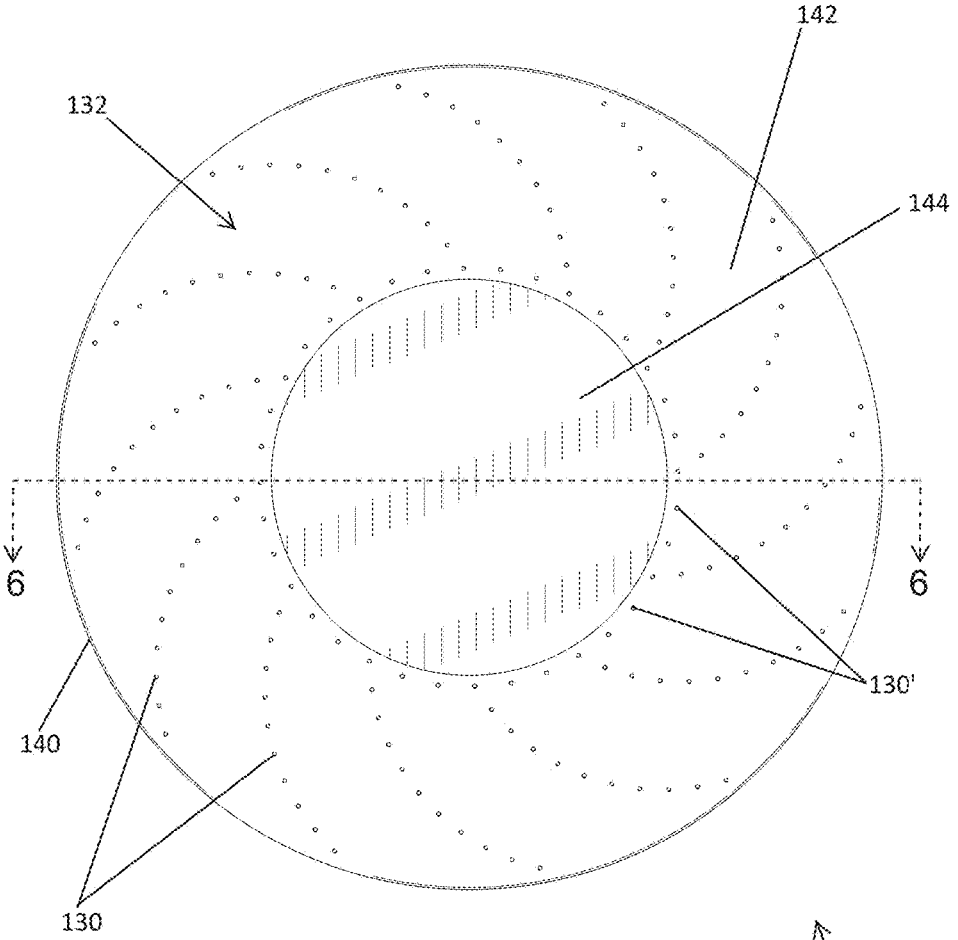
FIG. 4 illustrates a top view of an embodiment of the fire burner.
Figure 5:
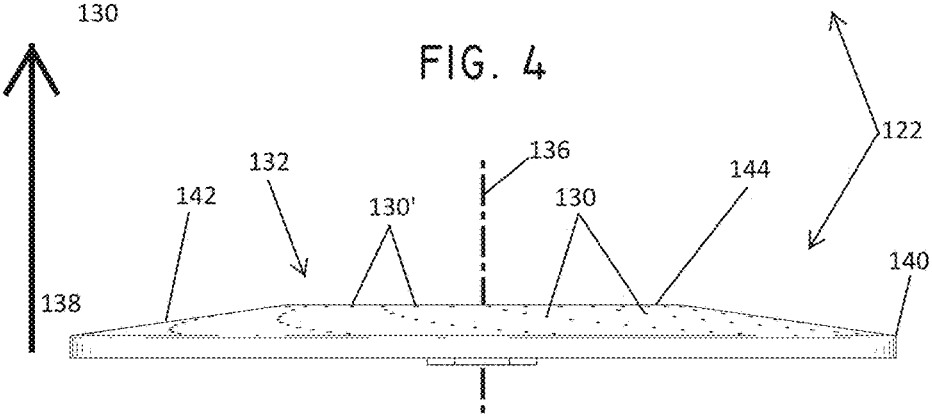
FIG. 5 illustrates a side view of an embodiment of the fire burner.

FIG. 4 illustrates a top view of an embodiment of the fire burner 122. As illustrated in FIG. 4, the fire burner 122 can have a generally round or circular shape (e.g., at the periphery 140 about the central axis 136). In some embodiments, the fire burner 122 may other suitable shapes, such as for example, oval, square, pentagonal, hexagonal, octagonal, etc. As illustrated in FIGS. 3 to 5, the fire burner 122 can have a general appearance or shape of a disc, dish, or flying saucer with the various geometrical characteristics of the fire burner 122 as discussed herein. Other shapes can include a cone, dome, spherical, oval, and/or pyramidal shape.

The fire burner 122 can have combustion ports 130 placed in a curved pattern as discussed herein. The fire burner 122 can have combustion ports placed in other or different patterns. As illustrated in FIG. 4, the fire burner 122 can have combustion ports 130' placed in a circular or round pattern about the center of the fire burner 122 (e.g., about the central portion 144 and/or about the central axis 136 at a substantially constant radius from the central axis 136). The combustion ports 130' can be in other desired or predetermined patterns as discussed herein. The combustion ports 130' can increase the combustion rate or combustion of fuel proximate to the center of the fire burner 122 relative to the combustion rate or combustion of fuel proximate to the periphery 140. By increasing the combustion of fuel proximate to the center of the of the fire burner 122, the combustion byproducts can be relatively hotter proximate to the center of the fire burner 122 such that combustion byproducts rise at a faster rate along direction arrow 138 relative to the combustion byproducts proximate to the periphery 140 as discussed herein. The relatively faster rate of rise of the central combustion byproducts causes the draw of the peripheral combustion byproducts and/or surrounding air toward the center of the fire pit 122 as discussed herein. Stated differently, the fire burner 122 can produce a flame or combustion byproducts that become progressively hotter (e.g. higher temperature) from the periphery 142 toward the center of the fire burner 122.

FIG. 5 illustrates a side view of an embodiment of the fire burner 122. The combustion ports 130 and/or combustion ports 130' can be placed on a sloping surface or wall 142 of the top portion 132 of the fire burner 122. The wall 142 can rise from the periphery 140 toward the central axis 136 along directional arrow 138. The rise in the wall 142 can elevate (e.g., position at a greater height) the combustion ports 130, 130' proximate to the center of the fire burner 122 (e.g., most proximate to the central axis 136) relative to the combustion ports 130, 130' proximate the periphery 140 of the fire burner 122. The rise or greater height of the combustion ports 130, 130' proximate to the center of the fire burner can elevate the central combustion byproducts relative to the peripheral combustion byproducts as discussed herein.

For example, as illustrated in FIG. 5, the combustion ports 130' placed in a circular pattern that can cause greater combustion heat toward the center of the fire burner 122 are elevated along directional arrow 138 (e.g., higher along the central axis 136) relative to the combustion ports proximate to the periphery 140 of the fire burner 122. Accordingly, as the peripheral combustion byproducts are pulled inward toward the hotter central combustion byproducts as discussed herein, the peripheral combustion byproducts are also simultaneously pulled upward by the immediately (upon combustion) higher central combustion byproducts. Accordingly, a further upward trajectory (beyond the upward trajectory created by the natural rise of hot combustion byproducts relative to ambient or surrounding air) is imparted on the peripheral combustion byproducts. As such, the peripheral byproducts are traveling at a faster overall rate when encountering the central combustion byproducts. With a faster rate of travel, the peripheral combustion byproducts have more momentum to cause the central combustion byproducts to spin or spiral.

Stated differently, by the physical placement of the combustion ports 130' to be higher relative to the combustion ports 130 (e.g., proximate to the periphery 140), the peripheral combustion byproducts travel upwards and inwards toward the central combustion byproducts (e.g., toward the center of the fire burner 122) along the sloped wall 142 due to the lower pressure created by the relatively faster rising, hotter central combustion byproducts. The upward travel of the peripheral combustion byproducts along the sloped wall 142 imparts a further upward trajectory to the peripheral combustion byproducts as the peripheral combustion byproducts are drawn toward the central combustion byproducts (e.g., center of the fire burner 122). The upward trajectory (e.g., rise) imparted on the peripheral combustion byproducts being drawn in or pulled in by the hotter central combustion byproducts provide momentum to the peripheral combustion byproducts that are traveling substantially along or correspondingly to a curved pattern to facilitate creating a vortex in the central or mix of the combustion byproducts.

Accordingly, the rise in the relatively hotter central combustion byproducts causes a convection action that draws the combustion byproducts (e.g., flame) from the periphery toward the center of the fire burner 122 as well as drawing in surrounding air as a vacuum is created about the periphery 140 of the fire burner 122. The more hot the central combustion byproducts are (e.g., by providing more or larger combustion ports toward the center of the fire burner 122), the greater the convection action to draw in the combustion products and/or air toward the center (e.g. like a chimney). Due to the convection action, the swirl shaped pattern of the flame can get or become closer together or is drawn in toward the center of the fire burner 122 while the flame rotates about the center axis 136 of the fire burner 122.

As illustrated in FIGS. 4 and 5, the fire burner 122 or top portion 132 of the fire burner 122 can have a central portion, area, plate, cover, or cap 144. The central portion 144 can be substantially flat or shaped to rise at smaller rate (e.g., relatively smaller angle of rise) than the wall 142 as discussed herein. As illustrated in FIG. 4, the central portion 144 can be a solid monolithic piece of material (e.g., the central portion 144 does not have combustion ports).

Figure 6:
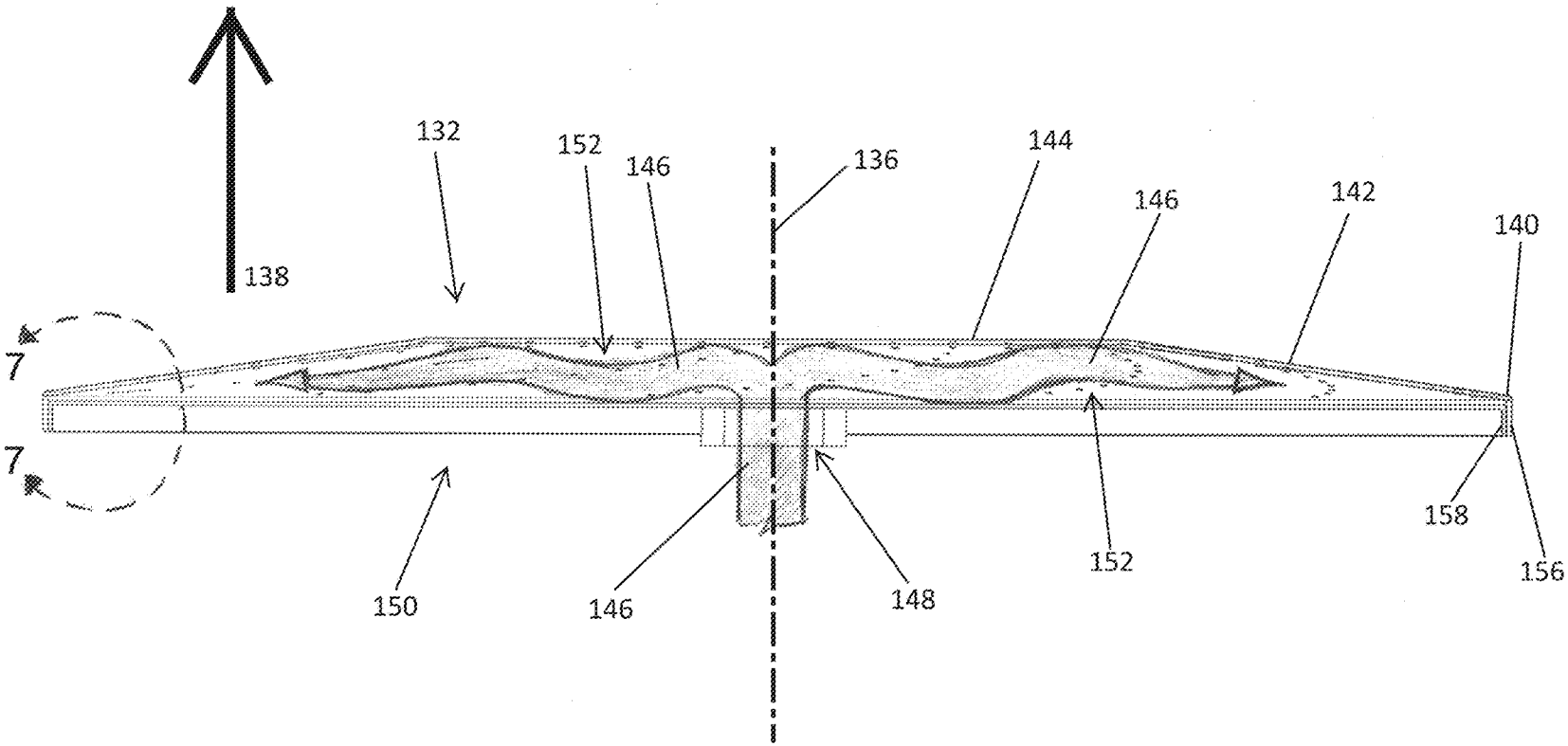
FIG. 6 illustrates a cross-sectional view of an embodiment of the fire burner as indicated in FIG. 4.

FIG. 6 illustrates a cross-sectional view of an embodiment of the fire burner 122 as indicated in FIG. 4. FIG. 6 illustrates an example flow of combustion gas 146 (e.g., fuel or air and fuel mixture entering the fire burner 122 after traveling through fuel connect 124 as discussed herein). The combustion gas 146 can enter through a fuel port 148 of a bottom, base, bottom component, or bottom portion 150 of the fire burner 122. A diameter of the fuel port 148 can be about 0.875 inches. In some embodiments, the diameter of the fuel port 148 can be about 0.5, 0.6, 0.7, 0.8, 0.9, 1, 1.1, 1.2 or greater than 1.2 inches, including the foregoing values and ranges bordering therein. After passing through the fuel port 148 the combustion gas 146 can begin to spread or disperse throughout an inner volume 152 of the fire burner formed by the top portion 132 and the bottom portion 150. The inner volume 152 can be a substantially enclosed space formed by the fire burner 122. As illustrated in FIG. 6, the inner volume 152 is formed when the top portion 132 in the bottom portion 150 are connected, mated, and/or joined as discussed herein. The top portion 132 and the bottom portion 150 when assembled can be considered an enclosure or housing (e.g., enclosing or housing the inner volume 152) of the fire burner 122.

As illustrated in FIG. 6, upon passing through the fuel port 148, the combustion gas 146 can travel upwards along directional arrow 138 or upwards along the central axis 136. The combustion gas 146 comes or flows against or encounters the central portion 144. The central portion 144 can stop the upward traveling trajectory of the combustion gas 146 (e.g., stop the upward momentum of the flow pattern of the combustion gas 146 by the combustion gas 146 being pressed or impinged against the central portion 144). Accordingly, the combustion gas 146 is directed outward toward the periphery 140 of the fire burner 122 as the combustion gas 146 comes against the central portion 144. Stated differently, upon coming against the central portion 144, the combustion gas 146 can be directed radially outward toward the periphery 140 throughout the inner volume 152.

By having a substantially planar or flat surface, the central portion 144 can direct and help further disperse the combustion gas 146 throughout the inner volume 152 (e.g., the combustion gas 146 substantially fills the inner volume 152 throughout the inner volume 152). For example, rather than immediately escaping, exiting, and/or leaving the inner volume 152 (e.g., if the central portion 144 was not present or had a relatively large combustion port near the central axis 136), the combustion gas 146 is forced to flow throughout the inner volume 152 upon striking or coming against the central portion 144. Accordingly, as illustrated in FIG. 6, the central portion 144 facilitates to evenly distribute the combustion gas 146 throughout the inner volume 152.

As discussed herein and further illustrated in FIG. 6, the walls 142 connect to the central portion 144 at an angle to form a downward slope (e.g., 01, see FIG. 9B) of the wall 142 toward the periphery 140 or stated differently, an upward slope (e.g., 01, see FIG. 9B) of the wall 142 toward the central axis 136. A downward slope toward the periphery 140 of the walls 142 can further help facilitate disbursing the combustion gas 146 throughout the inner volume 152. For example, as the combustion gas 146 flows from the central axis 136 and leaves a perimeter of the central portion 144 (e.g., perimeter about the central axis 136), the combustion gas 146 will start to leave the inner volume 152 through the combustion ports 130, 130' proximate to the center of the fire pit 122. Accordingly, there will be less combustion gas 146 present further out from the central axis 136 toward the periphery 140 as the combustion gas leaves the inner volume through the combustion ports 130, 130' while traveling generally toward the periphery 140.

As illustrated in FIG. 6, the bottom portion 150 can have a substantially flat or planar surface facing the inner volume 152 to facilitate dispersing the combustion gas 146 as discussed herein. The flat or planar surface of the bottom portion 150 can extend perpendicularly to the central axis 136. For example, a planar surface of the central portion 144 and a planar surface of the bottom portion 150 can extend along parallel planes perpendicular to the central axis 136. In some embodiments, the planar surface of the bottom portion 150 facing the inner volume 152 can be relatively slightly curved, such as for example, to reduce the size of the inner volume 152 proximate to the center of the fire burner 122 (e.g., a volume of the inner volume 152 corresponding to or directly below the central portion 144). Such a reduced inner volume 152 proximate to the center of the fire burner 122 can help further facilitate distribution of the combustion gas 146 toward the periphery 140 of the fire burner 122 as discussed herein.

The fire burner 122 (e.g., the top portion 132 and/or the bottom portion 150) can be made of spun stainless steel. In some embodiments, the fire burner 122 (e.g., the top portion 132 and/or the bottom portion 150) can be made of die cast or stamp-pressed steel, including steel alloys, and/or aluminum, including aluminum alloys. Other suitable materials can include any suitable form or alloy of cast or wrought iron or carbon steel or stamped materials.

Figure 7:
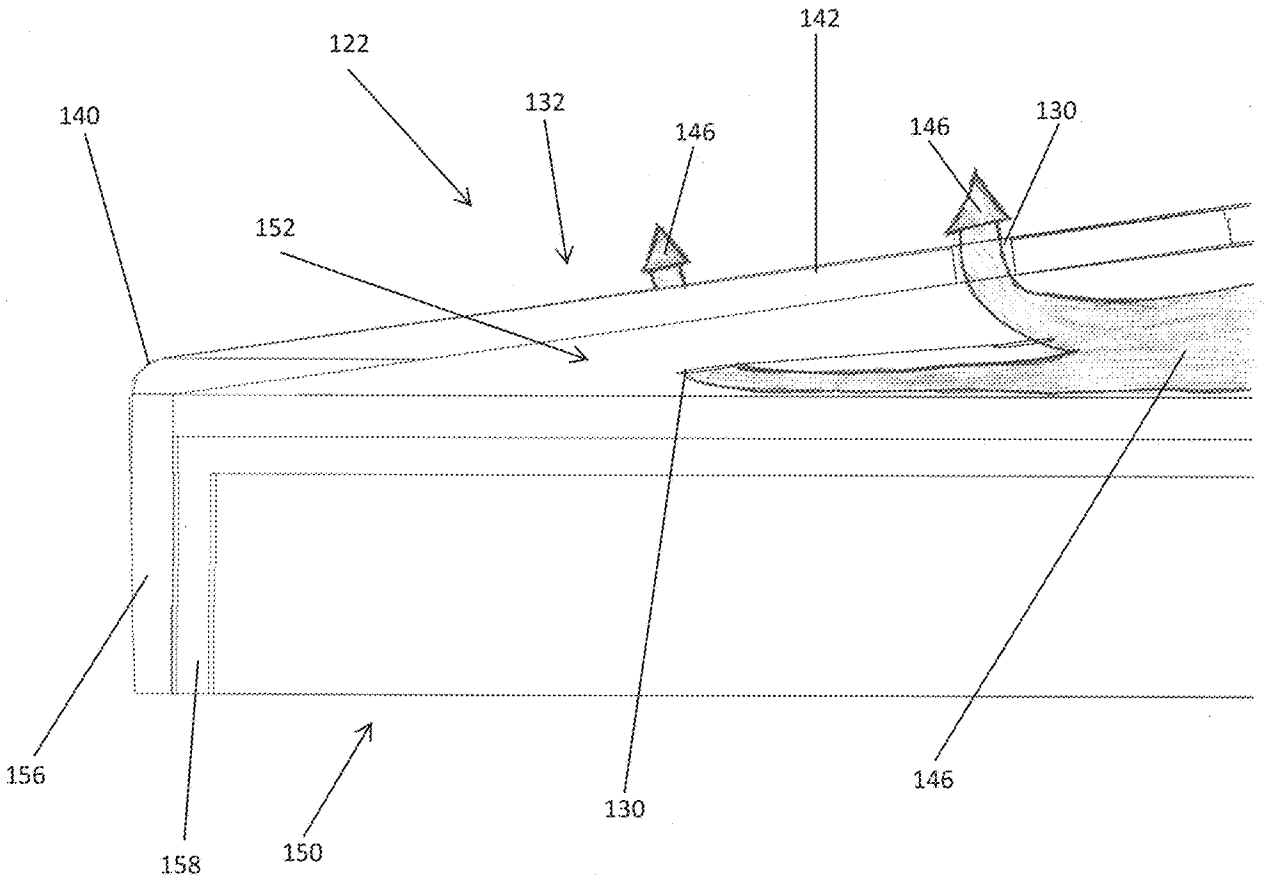
FIG. 7 illustrates a detailed view of area 7-7 of FIG. 6.

FIG. 7 illustrates a detailed view of area 7-7 of FIG. 6. As illustrated in FIG. 7, a downward slope of the walls 142 reduces the volume of the inner volume 152 as the combustion gas 146 approaches the periphery 140. A relatively smaller or reduced volume of the inner volume 152 toward the periphery 140 can facilitate the disbursement of the combustion gas 146 toward the outermost e.g., peripheral, combustion ports 130. For example, as the combustion gas 146 escapes through the combustion ports 130 while the combustion gas 146 travels toward the periphery 140, the pressure of the combustion gas 146 may lessen or be reduced proximate to the periphery 140. By having a relatively smaller inner volume 152 proximate to the periphery 140, the pressure of the combustion gas 146 can be substantially maintained or pressure thereof can be substantially minimized or mitigated such that at least some of the combustion gas 146 is directed to or forced through the combustion ports 130 most proximate to the periphery 140.

Figure 8:
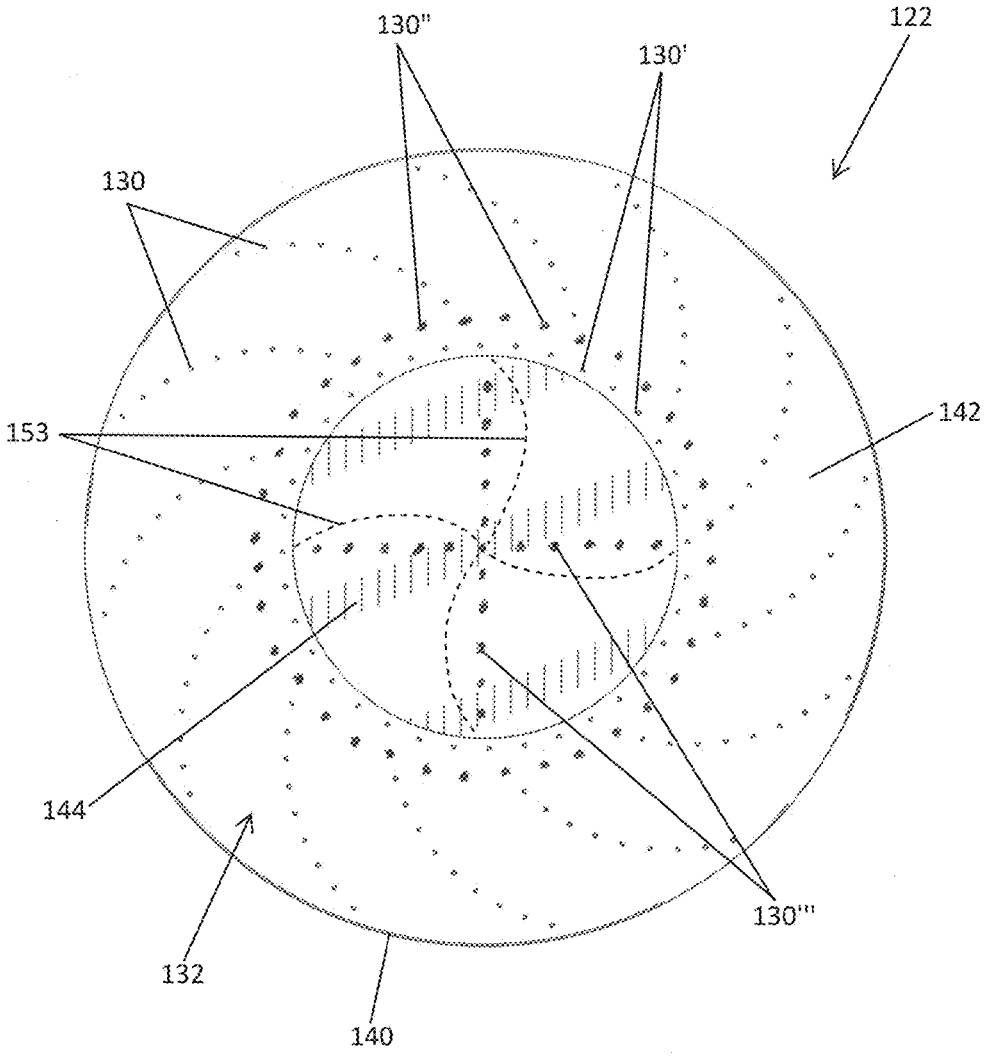
FIG. 8 illustrates a top view of an embodiment of the fire burner.

FIG. 8 illustrates a top view of an embodiment of the fire burner 122. The fire burner 122 can have different and/or additional combustion ports from the combustion ports 130, 130' as discussed herein. For example, the fire burner 122 may have spiral combustion ports 130 as discussed herein, but not any combustion ports positioned in a circular pattern, such as combustion ports 130'. Combustion ports 130' positioned in a circular pattern may not be necessary to generate relatively hotter combustion byproducts toward the center of the fire burner 122 in, for example, fire pits 102 with a lower BTU output (e.g., 20,000 to 60,000 BTU).

As illustrated in FIG. 8, the fire burner 122 may have additional combustion ports 130" positioned in a circular pattern in addition to the combustion ports 130' placed in a circular pattern. The combustion ports 130" may be positioned in a circular pattern around the first set of combustion ports 130' positioned in the circular pattern as discussed herein. For example, the combustion ports 130" can be positioned at a greater radius from the central axis 136 relative to the circular pattern of the combustion ports 130' positioned at a first radius as discussed herein. In some embodiments, the number of combustion ports 130' in a circular pattern as illustrated in FIG. 4 may be increased rather than adding an additional ring of combustion ports 130" as illustrated in FIG. 8.

As illustrated in FIG. 8, the fire burner 122 may have additional combustion ports 130''' positioned in a cross pattern through the central portion 144. In some embodiments, the combustion ports 130''' may be positioned along dashed lines 153 to continue the curved pattern of the combustion ports 130 toward the center (e.g., central axis 136) of the fire burner 122. In some embodiments, the combustion ports 130''' may be positioned in both the cross pattern as illustrated in FIG. 8 and along dashed lines 153. The intersection point or center of the cross pattern and/or dashed lines 153 can substantially be at or on center of the fire burner 122 (e.g., the central axis 136). The combustion ports 130''' can be of a smaller diameter relative to the other combustion ports 130, 130', 130" such that while at least some of the combustion gas 146 escapes or passes through at the central portion 144, a sufficient amount of combustion gas 146 is still directed toward the periphery 140 in the inner volume 152 as discussed herein (e.g., dispersed throughout the inner volume 152 by coming against the central portion 144). In some embodiments, the combustion ports 130''' can be of a larger diameter (or both larger and smaller) relative to the other combustion ports 130, 130', 130" to provide further heat concentration of the combustion byproducts toward the center of the fire burner 122 as discussed herein.

The additional combustion ports 130", 130''' as illustrated in FIG. 8 can be added to the fire burner 122 to further increase the relative heat of the combustion byproducts toward the center of the fire burner 122. The additional combustion ports 130", 130''' can be added to fire pits 102 with a relatively higher BTU output (e.g. 60,000 to 90,000 or more than 90,000 BTU).

Figures 9A, 9B:
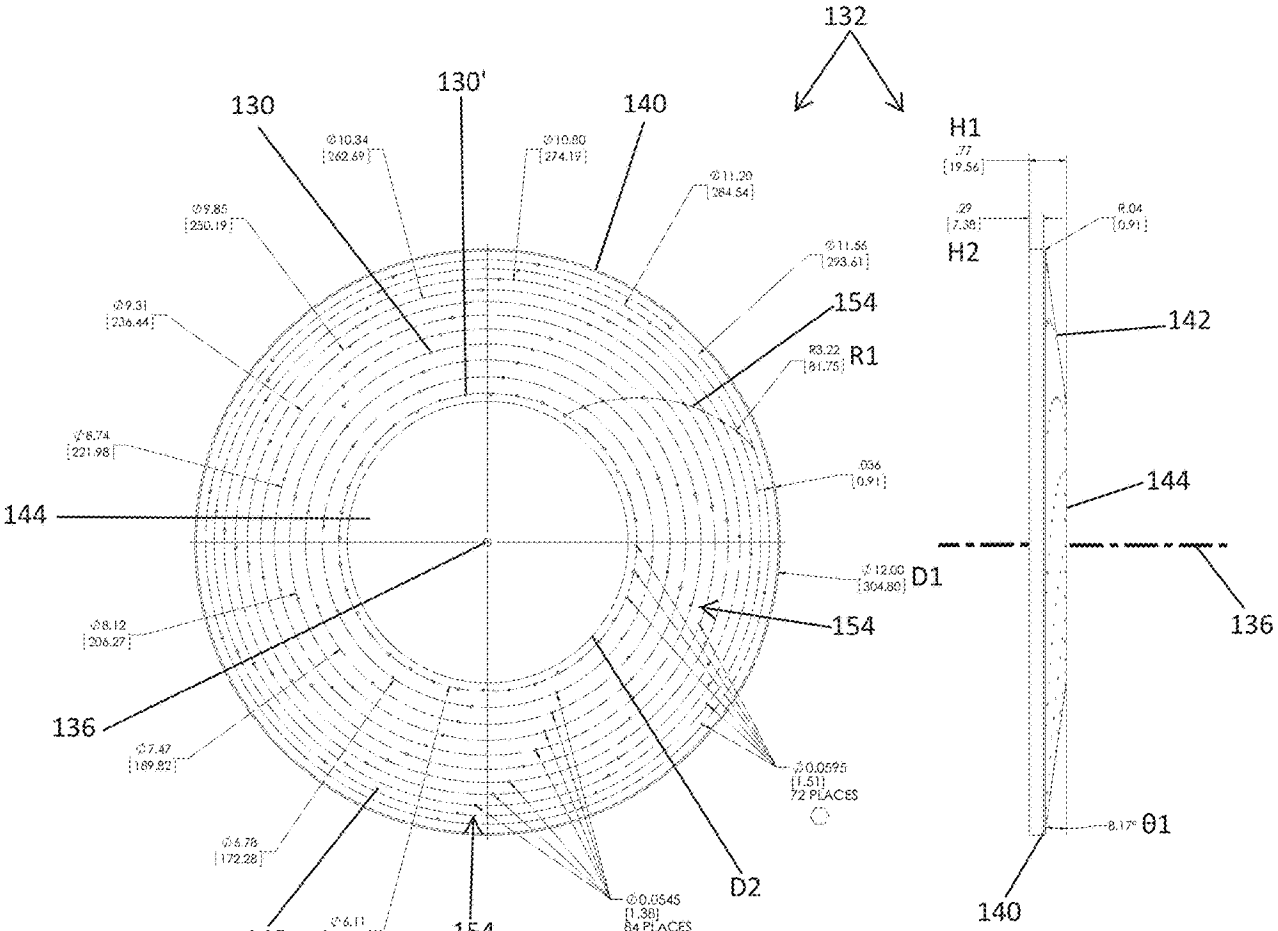
FIGS. 9A and 9B illustrate top and side views of an embodiment of a top portion of the fire burner.

FIGS. 9A and 9B illustrate top and side views of an embodiment of a top portion 132 of the fire burner 122. FIGS. 9A and 9B illustrate various possible dimensions of the features of the fire burner 122 as discussed herein. The dimensions illustrated in FIGS. 9A and 9B are in inches unless otherwise discussed herein. The dimensions illustrated in brackets (e.g. [X.XX]) in FIGS. 9A and 9B are in millimeters unless otherwise discussed herein. As illustrated in FIG. 9A, the top portion 132 can have an outer diameter D1 of about 12 inches. In some embodiments, the outer diameter D1 of the fire burner 122 can be about 6, 7, 8, 9, 10, 11, 13, 14, 15, 16, 17, 18 or more than 18 inches including the foregoing values and ranges bordering therein. For example, smaller diameter fire burners and/or top portions can be used with lower BTU output fire pits 102 (e.g., 40,000 BTU). Larger diameter fire burners and/or top portions can be used with higher BTU output fire pits 102 (e.g., 90,000 BTU).

A diameter D2 of the central portion 144 can be about 5.7 or 5.8 inches. In some embodiments, the diameter D2 of the central portion 144 can be about 2, 3, 4, 6, 7, 8, 9, 10, 11, 12 or more than 12 inches including the foregoing values and ranges bordering therein. The diameter D2 of the central portion 144 can be varied depending on the desired combustion gas 146 disbursement and/or relative combustion temperature proximate to the center of the fire pit 122 as discussed herein. For example, when more relatively hotter combustion byproducts are desired near the center of the fire burner 122, the diameter D2 of the central portion 144 can be relatively smaller (e.g. about 2 to 4 inches) such that less of the combustion gas 146 is dispersed by the central portion 144 as discussed herein and relatively more combustion gas 146 escapes from the enclosed volume 152 near the center of the fire pit 122.

As illustrated in FIG. 9A, the combustion ports 130, 130' can be placed about the central axis 136 at various predetermined radii. Depending on the positioning of the combustion ports 130, 130 about the predetermined radius, the combustion ports 130' can form a circular pattern as discussed herein, and/or the combustion ports 130 can form a curved pattern as discussed herein. As illustrated in FIG. 9A, the combustion ports 130 can be placed in a curved pattern at the various radii such that an arm 154 of the curved pattern extends on the top portion 132 at a radius R1 of about 3.2 inches. In some embodiments, the radius R1 can be about 1, 1.5, 2, 2.5, 3, 3.5, 4, 4.5, 5, 5.5, 6, 6.5, 8, 8.5, 9, or 9.5 inches including the foregoing values and ranges bordering therein. As illustrated in FIG. 9A, a spiral arm 154 can represent a line or path along which combustion ports are positioned on the top portion 132. The spiral arms 154 can be arranged along an arced, arched, elliptical, rounded, nonlinear, and/or curvilinear path or line. In some embodiments, the combustion ports 130 can be placed along straight or substantially straight lines with or without arc lines of the spiral arm 154 as discussed herein such that the straight lines project along a travel path directed away from the central line 136 of the fire burner 122 (e.g., not intersecting or directed into the central axis 136) to produce a spiraling or vortex-patterned flame as discussed herein. The lines (e.g., spiral arms 154) can extend adjacent to each other between the central portion 144 and the periphery 140. Accordingly, along each line (e.g., arms 154) of the curved pattern, a series of combustion ports can be positioned on the fire burner 122 in a spiral arrangement on the fire burner 122 (e.g., wall 142).

As illustrated in FIG. 9A, an arm 154 can form an arc, arch, bow, crescent, and/or half-moon pattern on the top portion 132. The radius R1 of an arm 154 of the curved pattern can vary depending on the size of the fire burner 122. For example for smaller diameter D1 fire burners, the radius R1 can be about 1 to 2 inches. For larger diameter D1 fire burners, the radius R1 can be about 3 to 6 inches. As illustrated in FIG. 9A, the combustion ports 130 and/or spiral arms 154 are farther apart toward the periphery 140 of the fire burner 122 relative to the density of the combustion ports 130 proximate to the center of the fire burner 122. The combustion ports 130 and/or spiral arms 154 get progressively closer together as the spiral arms approach the central portion 144 from the periphery 140. The relatively closer vicinity of the combustion ports 130 proximate to the center of the fire burner 122 (e.g., proximate or closer to the central axis 136) further facilitate the combustion of fuel at a relatively higher temperature toward the center of the fire burner 122.

As illustrated in FIG. 9A, the top portion 132 can have 12 spiral arms. In some embodiments, the top portion 132 can have 4, 5, 6, 7, 8, 9, 10, 11, 13, 14, 15, 16, 18, 19, 20 or more than 20 spiral arms 154 depending on combustion port pattern, BTU output of the fire pit 102, and/or desired flame curved pattern. Different number spiral arms 154 and/or combustion ports 130, 130', 130", 130''' (including various diameters as discussed herein) can be used to provide various heat conduction, heat concentration, and/or burning rates.

As illustrated in FIG. 9A, the combustion ports 130, 130' can have various diameters (e.g., openings in the top portion 132 into or in fluid communication with the inner volume 162). The various diameters of combustion ports 130, 130' can be placed at predetermined or desired locations on the top portion 132 to achieve the desired pattern of combustion heat and/or flame pattern as discussed herein. For example, as illustrated in FIG. 9A, the combustion ports 130' that are placed in a circular pattern about the central portion 144 can have a diameter of about 0.0595 inches.

As illustrated in FIG. 9A, a spiral arm 154 of the curved pattern can have various diameters of combustion ports 130. For example, a spiral arm 154 can have four combustion ports 130 with a diameter of about 0.0545 inches extending from the combustion ports 130' and/or central portion 144. Following, one combustion port 130 with a diameter of about 0.0595 inches can be positioned in the spiral arm 154. Following, three combustion ports 130 with a diameter of about 0.0545 inches can be positioned in the spiral arm 154. Following, two combustion ports 130 with a diameter of about 0.0595 inches can be positioned in the spiral arm 154. In some embodiments, the diameter of the combustion ports 130, 130', 130", 130'" can range from 0.02 to 0.2, including 0.3 to 1.5, including 0.4 to 1, and including 0.5 to 0.7, inches, including the foregoing values and ranges bordering therein.

In some embodiments, the three combustion ports with a diameter of 0.0545 inches and the two combustion ports 130 with a diameter of 0.0595 inches most proximate to the periphery 140 can be considered the peripheral combustion ports 130 or combustion ports 130 that are proximate to the periphery 140 as discussed herein. In some embodiments, the one combustion port with a diameter of 0.0595 inches and/or the three combustion ports 130 with a diameter of 0.0545 inches proximate to the central portion 144 can also be considered peripheral combustion ports 130 as discussed herein. What is considered to be peripheral combustion ports 130 as discussed herein can vary depending on the combustion port pattern, BTU output of the fire pit 102, and/or desired flame curved pattern (e.g., desired heat output variance from the periphery toward the center of the fire burner 122).

As illustrated in FIG. 9A, the combustion ports 130' positioned in a circular pattern can be of a smaller diameter relative to at least some of the other combustion ports (e.g., combustion ports 130) such that a majority portion of the combustion gas 146 is substantially prevented or inhibited from escaping from the inner volume 152 proximate to or at the center of the fire burner 122 (e.g., at the combustion ports 130') for the combustion gas 146 to fill the inner volume 152 more completely toward the periphery 140 of the fire burner 122 (e.g., to provide at least some combustion of fuel at the combustion ports 130 proximate to the periphery 140 as discussed herein).

As illustrated in FIG. 9A, the combustion ports 130 positioned in a curved pattern (e.g., part of the spiral arms 154) proximate to the periphery 140 of the fire burner 122 can be of a smaller diameter relative to at least some of the other combustion ports (e.g., combustion ports 130) such that while at least some combustion or flame is present at or proximate to the periphery 140, combustion at a higher temperature is still concentrated toward the center of the fire burner 122 as discussed herein (e.g., via greater density of and/or larger diameter combustion ports more proximate to the center of the fire burner 122).

If more combustion ports are desired for a given flame height and/or luminescence, relatively smaller diameter combustion ports 130 may be placed along the spiral arms, such as at substantially a center of a spiral arm 154 (e.g., at a diameter of about 9.3 inches as illustrated in FIG. 9A). Placing relatively smaller diameter combustion ports 130 proximate to the center of the spiral arms 154 can help maintain the desired ratio of combustion port area to fuel orifice area while still providing the desired combustion at the periphery 140 of the fire burner 122 (e.g., by not placing all of the smaller diameter combustion ports 130 at the periphery 140 such that insufficient amount of combustion occurs proximate to the periphery 140 of the fire burner 122).

When increasing the diameter (e.g., size) of the combustion ports 130, 130', 130", 130'", a high-pressure flame that is relatively tall can be created. If the diameter of the combustion ports 130, 130', 130", 130'" becomes too large, the combustion of fuel may become inefficient (e.g., the flame may be a luminescent yellow, but create soot/smoke that is undesirable). To alleviate inefficient burn, the number of holes may be increased while maintaining the desired or predetermined range of combustion port area to fuel orifice area as discussed herein. For example, as the number of combustion ports 130, 130', 130", 130'" is increased, the total area of combustion port area may be correspondingly decreased. Stated differently as number of combustion ports 130, 130', 130", 130'" is decreased, the total area of combustion port area may be correspondingly increased. The diameter of the various combustion ports 130, 130', 130", 130'" may be varied as the number of combustion ports is increased. For example, as the number of combustion ports 130, 130', 130", 130'" is increased, smaller diameter combustion ports may be added to the fire burner 122 to maintain the desired ratio of combustion port area to fuel orifice area as discussed herein as well as maintain the desired flame height as discussed herein. A balance may be achieved of providing a yellow flame with a desired flame height while minimizing inefficient combustion of fuel.

The number of combustion ports 130, 130', 130", 130'" (any combination thereof) can be optimized to achieve desired flame results based at least partly on the diameter of the combustion ports. The pressure at the fire burner 122 should not exceed the pressure at the fuel orifice 126. If the pressure at the fire burner 122 is greater than the pressure at the fuel orifice 126, then back pressure may result in a reduction of air being inducted into the venturi openings 128. A reduction of air being inducted into the venturi openings 128 can result in unburned fuel. To avoid back pressure, the total area opening of the combustion ports 130, 130', 130", 130'" can equal or exceed the opening area of the fuel orifice 126.

Increasing the number of combustion ports 130, 130', 130", 130'" can result in a more efficient burning fuel, but a lower flame height and less flame luminescence. For example, with an increased number of combustion ports 130, 130', 130", 130'", the relative back pressure at the fuel orifice 76 is decreased, resulting in a leaner fuel-air mixture. With a leaner fuel-air mixture, the resulting flame can be hotter and more efficient, but smaller and bluer (harder to see than a yellow flame in, for example, daylight). Reducing the number of combustion ports can result in a less efficient burn (the relative back pressure at the fuel orifice 126 is increased, resulting in a richer fuel-air mixture), but a higher flame height and yellow flame luminescence. A balance between the number and the total area opening of the combustion ports 130, 130', 130", 130'" relative to the fuel orifice area can be achieved to result in a high flame height with a high (yellow) flame luminescence and an efficient burn. A desired or high flame height can be about 2 to 60 inches, including about 12 to 36 inches, and/or about 1 to 59, including about 11 to 35 inches higher than the tabletop 112 of the fire pit 102.

The balance discussed herein to achieve a desired flame height and/or flame pattern can result in a ratio range of the total orifice or opening area of the combustion ports 130, 130', 130", 130''' (any combination thereof) to the opening area of the fuel orifice 126. In some embodiments, the ratio of the areas can range from about 1.5:1 to 5:1, including 2:1 to 4.5:1, including ranges bordering and the foregoing values. For example, in some embodiments of the fire pit 122 as illustrated in FIGS. 9A and 9B, 156 combustion ports 70 can have a total opening area of about 0.396 square inches. In some embodiments, a 90,000 BTU fire pit can have an opening area of the fuel orifice 126 of about 0.107 square inches. A total orifice area of about 0.396 square inches of the combustion ports and an opening area of about 0.107 square inches of the fuel orifice 126 results in a ratio of about 3.7:1. In some embodiments, the fuel orifice 126 can have an opening area of about 0.05 to about 1 square inches, including about 0.1 to about 0.6 inches, including ranges bordering and the foregoing values. The fire burner 122 and area ratio features discussed herein can be applied to liquefied petroleum, natural gas, and/or other similar fuels for the fire pit 102. In some embodiments, the number of combustion ports 130, 130', 130", 130''' can range from 5-300, including 100-200, including 110-150, including the foregoing values and ranges bordering therein.

As illustrated in FIG. 9B, the top portion 132 can have a wall 142 with a downward slope or an upward slope θ1 (from the perspective of the periphery 140 or the central portion 144, respectively) with respect to the planar surface of the central portion 144 (e.g., a plane perpendicular to the central axis 136). As illustrated in FIG. 9B, the slope θ1 can be about 8.17° (degrees). In some embodiments, the slope θ1 can be about 2, 3, 4, 5, 6, 7, 8, 9, 10, 11, 12, 13, 14, 15, or more than 15 degrees, including the foregoing values and ranges bordering therein. In some embodiments, the slope θ1 can be about 1-45, 2-30, 4-15, or 5-10 degrees, including the foregoing values and ranges bordering therein. Depending on the outer diameter D1 of the top portion 132 and the diameter D2 of the central portion 144, the wall 142 can extend from the central portion 144 to the periphery 140 about 3.2 inches at slope θ1. In some embodiments, the wall 142 can extend from the central portion 144 to the periphery 140 about 1, 2, 3, 4, 5, 6, 7, 8, 9, 10, 11, 12, 13, 14, 15, or 16 inches, including the foregoing values and ranges bordering therein, at slope θ1.

Depending on the diameter of the central portion 144, the diameter of the top portion 132, slope θ1, and/or extent of the flanges 156, 158 as discussed herein, the fire burner 122 and in particular the top portion 132 can have a predetermined height H1 along the central axis 136. As illustrated in FIG. 9B, the top portion 132 can have a height H1 of about 0.77 inches. In some embodiments, the top portion 132 can have a height H1 of about 0.4, 0.5, 0.6, 0.7, 0.8, 0.9, 1, 1.1, 1.2, 1.3, 1.4, 1.5, or more than 1.5 inches, including the foregoing values and ranges bordering therein. The inner volume 152 as discussed herein can vary in size (e.g., volume) depending on for example, the height H1, which can also depend on the other geometrical characteristics of the fire burner 122 as discussed herein.

Figure 10:
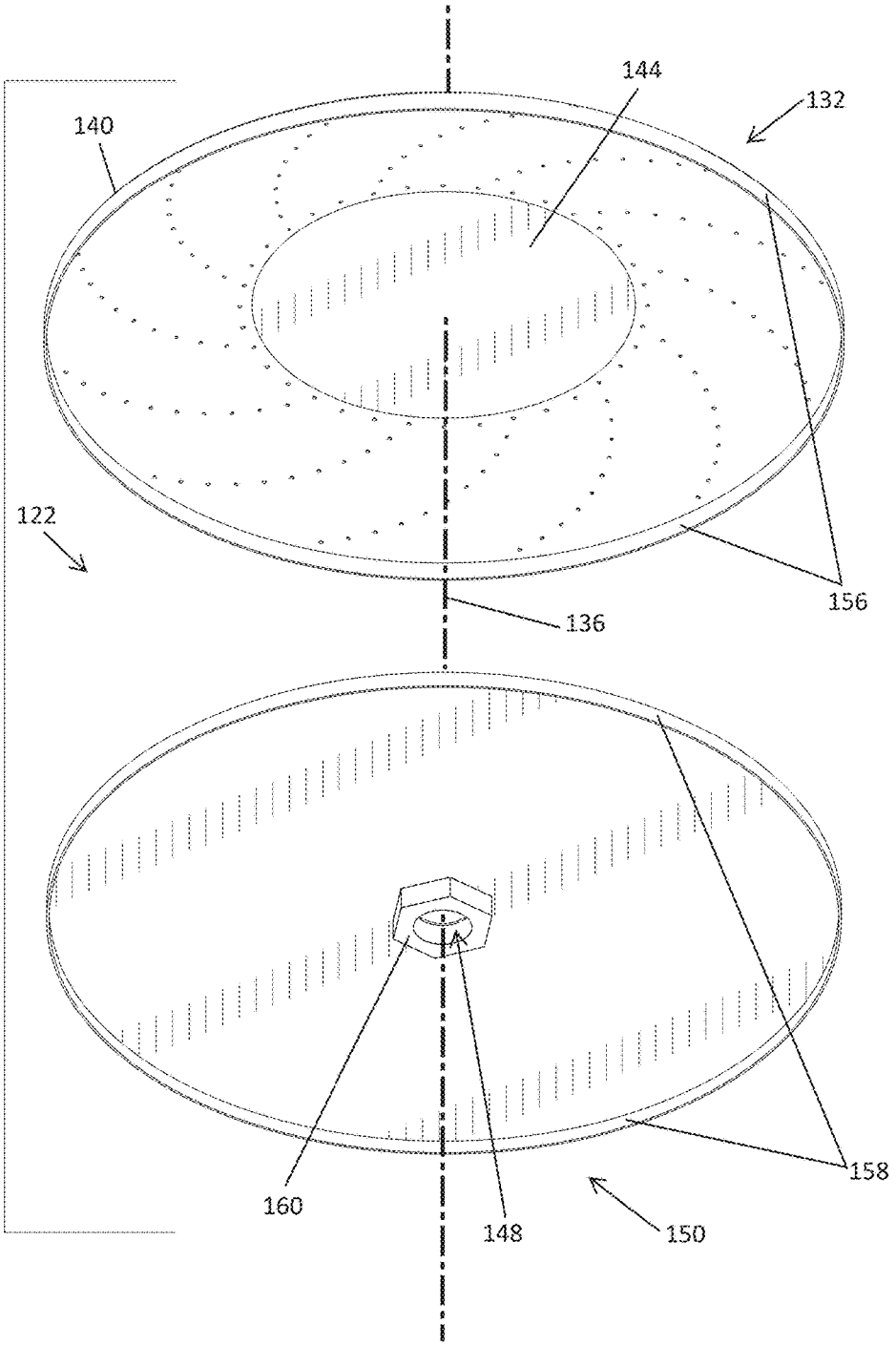
FIG. 10 illustrates a bottom isometric exploded view of an embodiment of the fire burner.
Figure 11:
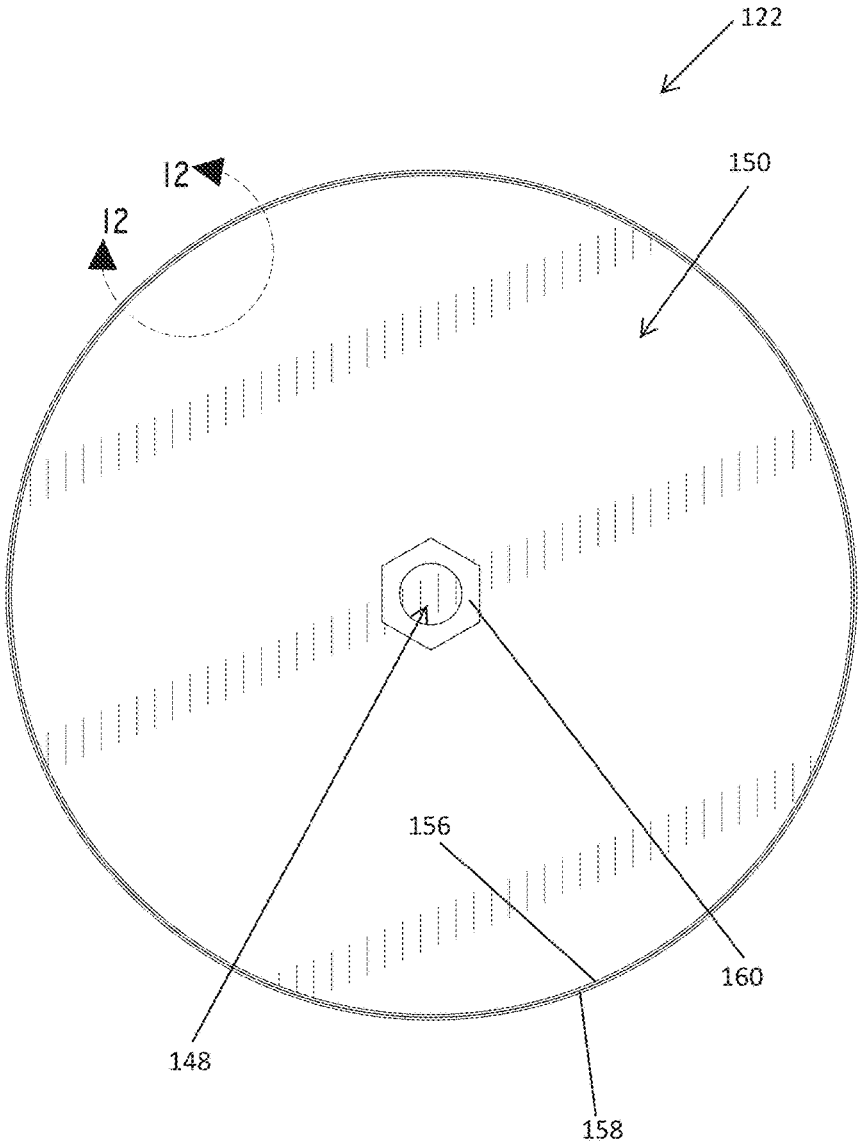
FIG. 11 illustrates a bottom view of an embodiment of the fire burner.
Figure 12:
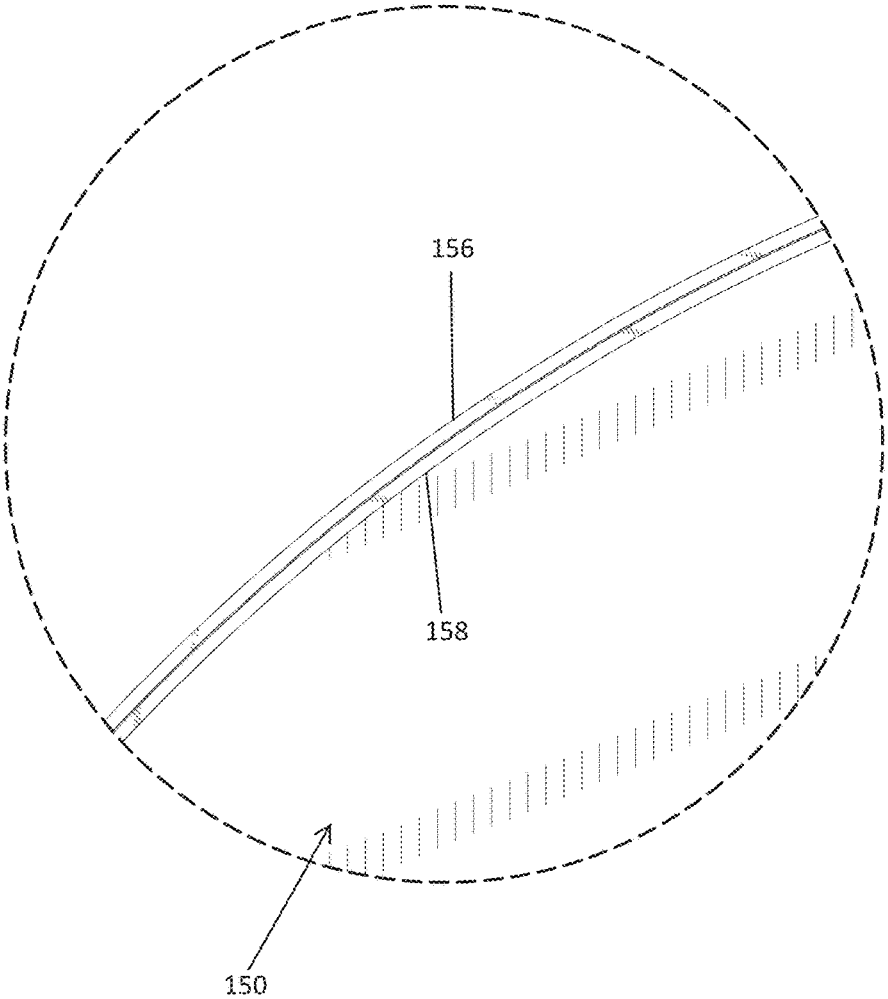
FIG. 12 illustrates a detailed view of area 12-12 in FIG. 11.

FIG. 10 illustrates a bottom isometric exploded view of an embodiment of the fire burner 122. FIG. 11 illustrates a bottom view of an embodiment of the fire burner 122. FIG. 12 illustrates a detailed view of area 12-12 in FIG. 11. As illustrated in FIGS. 10 to 12, the top portion 132 of the fire burner 122 can have a skirt or flange 156. The bottom portion 150 of the fire burner 122 can also have a skirt or flange 158. The flange 156 can be connected to the top portion 132 at or proximate to the perimeter or periphery 140. The flange 156 can extend substantially downwards along the central axis 136. The flange 158 can connect to the bottom portion 150 at or proximate to a perimeter or periphery of the bottom portion 150.

As illustrated in FIGS. 11 and 12, as well as referring back to FIGS. 6 and 7, the top portion 132 and the bottom portion 150 can be connected, mated, joined, and/or assembled via the flanges 156, 158. As illustrated in the FIGS. 6, 7, 11, and 12, the flange 158 of the bottom portion 150 can be positioned to fit within an inner diameter of the flange 156 of the top portion 132 about the central axis 136. Accordingly, the bottom portion 150 can be connected to the top portion 132 at a desired or predetermined position relative to the top portion 132 when the flange 156 circumscribes the flange 158. As illustrated in FIG. 12, the dimensional tolerances between the flanges 156, 158 can be sufficient to secure the bottom portion 150 relative to the top portion 132 at a desired position via, for example, the flange 158, resting within the flange 156. For example, when the outer diameter of the fire burner 122 (e.g., at the periphery 140) is about 12 inches, an outer diameter of the bottom portion 150 can be about 11.92 inches with the thickness of the flange 156 of the top portion 132 being about 0.072 inches to provide about 0.008 inches of clearance (e.g., a tight or secure fit). An example thickness of flange 158 of the bottom portion 150 can be about 0.036 inches.

When assembling the top portion 132 and the bottom portion 150, a heat sealing compound (e.g., ceramic based) can be applied between the mating or connecting surfaces of the flanges 156, 158. Upon assembling the top portion 132 and the bottom portion 150, the flanges 156, 158 can be mechanically crimped together to help ensure a physical interference fastening the top portion 132 and the bottom portion 150. Any other suitable attachment mechanisms between the top portion 132 in the bottom portion 150 can be used such as for example, interference fit mechanisms, snap fit mechanisms, and the like, which can include using male and female mating parts (e.g., tongue-and-groove corresponding parts).

As illustrated in FIG. 9B, the flange 156 and/or flange 158 can extend downward along the central axis 136 (e.g. oppositely of directional arrow 138). The flanges 156, 158 can extend a predetermined distance H2 (e.g., height) to connect the top and bottom portion 132, 150 and to optionally provide further aesthetic appeal to the fire burner 122. For example, the flanges 156, 158 can extend downward to be proximate to the burner tray 118 to minimize gaps between the burner tray 118 and the fire burner 122. The flanges 156, 158 can extend the predetermined distance H2 to also cover up other components of the fire pit 102 and/or fire burner 122, such as for example, the connection manifold 160 as discussed herein.

As illustrated in FIGS. 10 and 11, the fuel port 148 where the combustion gas 146 enters into the fire burner 122 can be a threaded port. The threaded portion of the fuel port 148 can be provided by a connection manifold 160, such as a threaded nut, that is connected, mated, and/or attached to the fire burner 122, and in particular, to the bottom portion 150 such that the openings of the fuel port 148 and the opening of the connection manifold 160 correspond to allow flow of combustion gas 146 into the inner volume 152 as discussed herein. The fuel port 148 and/or connection manifold 160 can be any appropriate size to mate with fuel connector 124, including a ¼, ½, ¾, 1 inch, and more than 1 inch standard pipe coupling. Standard pipe coupling mechanisms can include threading, welding, interference fit, and/or the like. Any other suitable connection mechanisms between the fuel port 148 and the connection manifold 160 can be used such as, for example, interference fit mechanisms, snap fit mechanisms, and the like, which can include using male and female mating parts (e.g., tongue-and-groove corresponding parts).

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue." It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. Features of embodiments disclosed herein preceded by a term such as "approximately", "about", and "substantially" as used herein represent the feature with some variability that still performs a desired function or achieves a desired result for that feature.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. A fire burner comprising:

an enclosure comprising an inner volume extending between a center of the enclosure and a periphery of the enclosure;

a fuel port configured to allow combustion gas to enter the inner volume; and a plurality of combustion ports in fluid communication with the inner volume, the combustion ports configured to allow fuel to leave the inner volume at the combustion ports and combust proximate to the combustion ports, at least some of the plurality of combustion ports positioned in a curved pattern on the enclosure, one or more combustion ports of the plurality of combustion ports positioned proximate to the center of the enclosure, and one or more other combustion ports of the plurality of combustion ports positioned proximate to the periphery of the enclosure, wherein upon combustion of the fuel to form combustion byproducts, the combustion byproducts are at a higher temperature proximate to the center of the enclosure relative to the periphery of the enclosure such that combustion byproducts at the periphery are drawn toward the center of the enclosure, wherein the combustion byproducts proximate to the periphery are drawn toward the center substantially along paths corresponding to the curved pattern of the at least some of the plurality of combustion ports such that the combustion byproducts rotate about the center of the enclosure as the combustion byproducts rise away from the enclosure, and wherein the inner volume becomes progressively smaller toward the periphery of the enclosure to maintain pressure of the fuel toward the periphery of the enclosure such that at least some of the fuel leaves the inner volume and combusts proximate to the periphery of the enclosure.

2. The fire burner of claim 1, wherein at least some other combustion ports of the plurality of combustion ports are positioned in a circular pattern about the center of the enclosure to increase the higher temperature of the combustion byproducts proximate to the center of the enclosure.

3. The fire burner of claim 1, wherein the fuel port is positioned at the center of the enclosure, and wherein the enclosure comprises a central portion positioned over the fuel port, the central portion configured to disperse the fuel toward the periphery of the enclosure within the inner volume when the fuel comes against the central portion.

4. The fire burner of claim 1, wherein at least one of the one or more other combustion ports of the plurality of combustion ports proximate to the periphery of the enclosure has a smaller diameter relative to other combustion ports of the plurality of combustion ports to minimize combustion of fuel proximate to the periphery of the enclosure and increase the higher temperature of the combustion byproducts proximate to the center of the enclosure.

5. The fire burner of claim 1, wherein at least one of the one or more other combustion ports of the plurality of combustion ports proximate to the center of the enclosure has a smaller diameter relative to other combustion ports of the plurality of combustion ports to facilitate dispersing the fuel in the inner volume toward the periphery of the enclosure.

6. A fire burner fire pit assembly comprising:

a fire pit comprising a tabletop supported by sides, the tabletop comprising an opening; and a fire burner in the opening, the fire burner comprising:

a top comprising a periphery, a cap at a center of the top, a wall connecting the periphery to the cap, and a plurality of combustion ports; and a bottom connected to the top, the bottom comprising a fuel intake at the center of the top, wherein the top is at a greater height along a central axis of the fire burner relative to the periphery where the wall connecting the cap to the periphery extends at an angle upwards from the periphery to cap such that a height of a volume enclosed by the top and the bottom increases along the central axis from the periphery toward the center of the top up to the cap, wherein the plurality of combustion ports are arranged in a curved pattern radiating from the center toward the periphery of the top along the wall of the top, wherein at least a portion of combustion gas entering the enclosed volume through the fuel intake of the bottom comes against the cap and is directed toward the periphery of the top such that at least some of the combustion gas flows out from one or more combustion ports of the plurality of combustion ports most proximate to the periphery, wherein upon combustion of the combustion gas, combustion heat is concentrated proximate to the cap such that greater combustion heat is generated near the center than at the periphery of the top, wherein as greater combustion heat is generated near the center of the top, combustion byproducts proximate to the center rise faster than combustion byproducts proximate to the periphery and combustion byproducts proximate to the periphery are drawn toward the center substantially along the curved pattern of the plurality of combustion ports to cause the combustion byproducts to vortex substantially about the central axis, and wherein the curved pattern of the plurality of combustion ports comprises combustion ports proximate to the cap being closer together relative to combustion ports proximate to the periphery, further concentrating the greater combustion heat near the center of the top.

7. The assembly of claim 6, wherein the fire burner comprises substantially a same density of the plurality of combustion ports at the center of the top and the periphery of the top.

8. The assembly of claim 6, wherein the cap is substantially planar perpendicular to the central axis.

9. The assembly of claim 6, wherein the angle of the wall is about 8.2 degrees.

10. The assembly of claim 6, wherein the angle of the wall is determined based on a desired height of combustion byproducts proximate to the cap above a height of combustion byproducts proximate to the periphery such that as the combustion byproducts proximate to the cap rises, the combustion byproducts proximate to the periphery are convectively drawn upward and toward the higher combustion gases proximate to the cap.

11. The assembly of claim 6, wherein at least some of the plurality of combustion ports are about 0.04 inches to about 0.08 inches in diameter.

12. The assembly of claim 6, wherein the curved pattern comprises the plurality of combustion ports forming arc paths extending along the wall of the top from the center of the top to the periphery of the top.

13. A method for providing a vortex pattern in a flame, the method comprising:

producing a flame with a temperature gradient across the flame such that the flame is relatively hotter toward a center of the flame relative to a periphery of the flame;

drawing the flame at the periphery of the flame toward the center of the flame that is hotter substantially along travel paths corresponding to a plurality of nonlinear lines; and causing the flame to rise and turn in a vortex pattern as the flame at the periphery is drawn toward the center of the flame substantially along the travel paths corresponding to the plurality of nonlinear lines, wherein drawing the flame at the periphery of the flame toward the center of the flame comprises drawing the flame inward.

14. The method of claim 13, wherein the nonlinear lines are curved.

15. The method of claim 13, further comprising dispersing a combustion gas from proximate to the center of the flame toward the periphery of the flame before the combustion gas combusts to produce the flame.

16. The method of claim 15, further comprising impinging the combustion gas against a planar surface to disperse the combustion gas toward the periphery of the flame.

17. The method of claim 15, wherein dispersing the combustion gas from the center of the flame toward the periphery of the flame comprises directing the combustion gas into a volume that tapers toward the periphery of the flame, the volume containing the combustion gas before the combustion gas combusts to produce the flame.

18. The fire burner of claim 1, wherein the enclosure comprises a sloping surface that slopes downwardly along a direction from the center of the enclosure toward the periphery of the enclosure, wherein the one or more other combustion ports of the plurality of combustion ports proximate to the periphery of the enclosure are positioned on the sloping surface such that the one or more other combustion ports of the plurality of combustion ports are at a lower height relative to one or more combustion ports of the plurality of combustion ports positioned proximate to the center of the enclosure, wherein the combustion byproducts at the periphery are drawn toward the center and upwards toward the combustion byproducts that are at the higher temperature proximate to the center of the enclosure.

19. The assembly of claim 6, wherein the top further comprises a flange extending about the periphery of the top, the flange configured to connect to the bottom to form the fire burner.

20. The method of claim 15, further comprising maintaining a desired pressure of the combustion gas at the periphery of the flame.

* * * * *